US010702123B2

(12) United States Patent
Lee et al.

(10) Patent No.: US 10,702,123 B2
(45) Date of Patent: Jul. 7, 2020

(54) DISHWASHER

(71) Applicant: Samsung Electronics Co., Ltd., Suwon-si (KR)

(72) Inventors: Chang Wook Lee, Seoul (KR); Seung Gee Hong, Suwon-si (KR); Hyung Kwen Ham, Seoul (KR); Ji Sun Yang, Seongnam-si (KR); Buesing Johannes, Yongin-si (KR); Soo Hyung Yoo, Suwon-si (KR); Seung Wan Yoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 215 days.

(21) Appl. No.: 15/642,670

(22) Filed: Jul. 6, 2017

(65) Prior Publication Data

US 2018/0055332 A1 Mar. 1, 2018

(30) Foreign Application Priority Data

Sep. 1, 2016 (KR) ..... 10-2016-0112871

(51) Int. Cl.
*A47L 15/42* (2006.01)
*A47L 15/16* (2006.01)
*A47L 15/23* (2006.01)

(52) U.S. Cl.
CPC ..... *A47L 15/4282* (2013.01); *A47L 15/16* (2013.01); *A47L 15/23* (2013.01); *A47L 15/4225* (2013.01); *A47L 15/4221* (2013.01)

(58) Field of Classification Search
CPC ..... A47L 15/4282; A47L 15/16; A47L 15/23; A47L 15/4225
USPC ..... 134/183
See application file for complete search history.

(56) References Cited

U.S. PATENT DOCUMENTS

| | | | | |
|---|---|---|---|---|
| 2013/0092194 | A1 | 4/2013 | Carlson et al. | |
| 2013/0319487 | A1 | 12/2013 | Hong et al. | |
| 2014/0299167 | A1 | 10/2014 | Hong et al. | |
| 2015/0182103 | A1* | 7/2015 | Jung | A47L 15/4282 134/182 |
| 2016/0106295 | A1 | 4/2016 | Thiyagarajan et al. | |

FOREIGN PATENT DOCUMENTS

| | | |
|---|---|---|
| EP | 2786691 | 10/2014 |
| EP | 2888983 | 7/2015 |
| JP | 7-116102 | 5/1995 |
| JP | 8-197025 | 8/1996 |

(Continued)

OTHER PUBLICATIONS

International Search Report dated Nov. 10, 2017 in International Patent Application No. PCT/KR2017/008048.

(Continued)

*Primary Examiner* — Tinsae B Ayalew
(74) *Attorney, Agent, or Firm* — Staas & Halsey LLP

(57) ABSTRACT

A dishwasher includes a main body, a washing tub provided inside the main body, and configured to wash dishes therein, a fixed nozzle assembly fixed to one side of the washing tub, and configured to spray washing water; and a vane installed inside the washing tub in such a way to be movable along a first direction, and configured to reflect washing water sprayed from the fixed nozzle assembly toward the dishes.

20 Claims, 32 Drawing Sheets

(56) References Cited

FOREIGN PATENT DOCUMENTS

| | | |
|---|---|---|
| JP | 2008-73131 | 4/2008 |
| JP | 2011-92316 | 5/2011 |
| JP | 2013-36389 | 2/2013 |
| KR | 1997-0061195 | 9/1997 |
| KR | 10-2009-0037299 | 4/2009 |
| KR | 10-2012-0117424 | 10/2012 |
| KR | 10-2015-0079335 | 7/2015 |
| KR | 10-2015-0080358 | 7/2015 |
| KR | 10-2015-0128094 | 11/2015 |
| KR | 10-2015-0142947 | 12/2015 |

OTHER PUBLICATIONS

Extended European Search Report dated Jun. 18, 2019 in European Patent Application No. 17846843.5.
European Office Action dated Nov. 13, 2019 in European Patent Application No. 17846843.5.

* cited by examiner

DISHWASHER

CROSS-REFERENCE TO RELATED APPLICATION

This application claims priority to and the benefit of Korean Patent Application No. 10-2016-0112871, filed on Sep. 1, 2016, the disclosure of which is incorporated herein by reference in its entirety.

BACKGROUND

1. Field

The present disclosure relates to a dishwasher, and more particularly, to a dishwasher having an improved structure to enhance washing efficiency.

2. Discussion of Related Art

A dishwasher is equipment to automatically wash food leftovers remaining on dishes using detergent and washing water.

The dishwasher includes a main body having a washing tub therein, a basket for storing dishes, a sump for storing washing water, a spray nozzle for spraying washing water, and a pump for pumping washing water stored in the sump and supplying it to the spray nozzle.

A plurality of baskets are provided such that two or more tiers are formed vertically in the washing tub. For example, in the washing tub, a first basket and a second basket are spaced a predetermined distance vertically from each other. Dishes that are to be washed are stored in the first basket or the second basket.

A plurality of spray nozzles are provided to spray washing water toward all of the dishes stored in the plurality of baskets. For example, the plurality of spray nozzles include a first spray nozzle to spray washing water toward the first basket from below, a second spray nozzle disposed between the first basket and the second basket to spray water, and a third spray nozzle to spray water toward the second basket from above.

The sump and the plurality of spray nozzles are connected to each other by a flow path, and water stored in the sump is pumped by the pump and supplied to the flow path. The water supplied to the flow path is sprayed toward the dishes stored in the plurality of baskets through the plurality of spray nozzles.

The water pressure and straightness of washing water are important factors for determining the washing efficiency of a dishwasher. Accordingly, various studies have been made to improve the straightness of washing water sprayed from a plurality of spray nozzles and to maintain the water pressure of washing water at a specific level or higher.

SUMMARY

It is an aspect of the disclosure to provide a dishwasher having an improved structure to enable separate washing.

It is an aspect of the disclosure to provide a dishwasher having an improved structure to enhance washing capability during separate washing.

It is an aspect of the disclosure to provide a dishwasher having an improved structure to increase the amount of valid washing water for washing dishes.

It is an aspect of the disclosure to provide a dishwasher having an improved structure to enhance the straightness of washing water.

In accordance with one aspect of the present disclosure, a dishwasher includes a main body, a washing tub provided inside the main body, and configured to wash dishes therein, a fixed nozzle assembly fixed to one side of the washing tub, and configured to spray washing water; and a vane installed inside the washing tub in such a way to be movable along a first direction, and configured to reflect washing water sprayed from the fixed nozzle assembly toward the dishes. The fixed nozzle assembly includes a first fixed nozzle facing the vane, a second fixed nozzle arranged along a second direction together with the first fixed nozzle to face the vane and an additional fixed nozzle positioned above the first fixed nozzle, and configured to be involved in separate washing together with the first fixed nozzle. The vane includes a reflection surface facing the fixed nozzle assembly and a plurality of reflection sections provided on the reflection surface along an up-down direction of the washing tub, and inclined at different angles with respect to a direction in which the washing water is sprayed from the fixed nozzle assembly.

The plurality of reflection sections includes a first reflection section struck by the washing water sprayed from the fixed nozzle assembly and a second reflection section provided above the first reflection section, and configured to guide the washing water toward the dishes and a third reflection section provided below the first reflection section.

An angle θ1 which the first reflection section forms with respect to the direction in which the washing water is sprayed from the fixed nozzle assembly is larger than an angle θ2 which the second reflection section forms with respect to the direction in which the washing water is sprayed from the fixed nozzle assembly, and an angle θ3 which the third reflection section forms with respect to the direction in which the washing water is sprayed from the fixed nozzle assembly.

An angle θ2 which the second reflection section forms with respect to the direction in which the washing water is sprayed from the fixed nozzle assembly is smaller than an angle θ1 which the first reflection section forms with respect to the direction in which the washing water is sprayed from the fixed nozzle assembly, and an angle θ3 which the third reflection section forms with respect to the direction in which the washing water is sprayed from the fixed nozzle assembly.

A dishwasher includes a main body, a washing tub provided inside the main body, and configured to wash dishes therein, a fixed nozzle assembly fixed to one side of the washing tub, and configured to spray washing water and a vane installed inside the washing tub in such a way to be movable along a first direction, and configured to reflect the washing water sprayed from the fixed nozzle assembly toward the dishes. The fixed nozzle assembly includes a first fixed nozzle facing the vane, a second fixed nozzle arranged along a second direction together with the first fixed nozzle to face the vane and an additional fixed nozzle positioned above the first fixed nozzle, and configured to be involved in separate washing together with the first fixed nozzle.

The second fixed nozzle is involved in separate washing, independently from the first fixed nozzle and the additional fixed nozzle.

In accordance with one aspect of the present disclosure, a dishwasher further includes an additional vane installed on the vane, and configured to reflect the washing water sprayed from the additional fixed nozzle toward the dishes.

The vane includes an additional vane fastening portion. Additional vane includes an additional vane body installed on the vane such that space is formed between the additional vane body and the vane to move washing water therethrough and a fastening rib extending from the additional vane body to be coupled to the additional vane fastening portion.

The vane includes a reflection surface facing the fixed nozzle assembly; and a plurality of reflection sections provided on the reflection surface along an up-down direction of the washing tub, and inclined at different angles with respect to a direction in which the washing water is sprayed from the fixed nozzle assembly.

The plurality of reflection sections include a first reflection section struck by the washing water sprayed from the fixed nozzle assembly, a second reflection section provided above the first reflection section, and configured to guide the washing water toward the dishes and a third reflection section provided below the first reflection section.

An angle θ1 which the first reflection section forms with respect to the direction in which the washing water is sprayed from the fixed nozzle assembly is larger than an angle θ2 which the second reflection section forms with respect to the direction in which the washing water is sprayed from the fixed nozzle assembly, and an angle θ3 which the third reflection section forms with respect to the direction in which the washing water is sprayed from the fixed nozzle assembly.

An angle θ2 which the second reflection section forms with respect to the direction in which the washing water is sprayed from the fixed nozzle assembly is smaller than an angle θ1 which the first reflection section forms with respect to the direction in which the washing water is sprayed from the fixed nozzle assembly, and an angle θ3 which the third reflection section forms with respect to the direction in which the washing water is sprayed from the fixed nozzle assembly.

Each of the first fixed nozzle and the second fixed nozzle includes a plurality of first fixed nozzles and a plurality of second fixed nozzles. The vane further includes a rib protruding from the reflection surface to partition a plurality of struck sections corresponding to the plurality of first fixed nozzles and the plurality of second fixed nozzles, respectively.

A recessed portion is formed in the plurality of struck sections.

Each of the first fixed nozzle, the second fixed nozzle, and the additional fixed nozzle includes a first flow path section positioned on the upstream side in a direction in which the washing water is sprayed from the fixed nozzle assembly, wherein a plurality of first spray flow paths are formed in the first flow path section and a second flow path section positioned on the downstream side in the direction in which the washing water is sprayed from the fixed nozzle assembly, wherein a single second spray flow path at which washing water passed through the plurality of first spray flow paths meets is formed in the second flow path section.

In accordance with one aspect of the present disclosure, a dishwasher includes a main body, a washing tub provided inside the main body, and configured to wash dishes therein, a fixed nozzle assembly fixed to one side of the washing tub, and configured to spray washing water and a vane movably installed inside the washing tub, and configured to reflect the washing water sprayed from the fixed nozzle assembly toward the dishes. The vane includes a reflection surface facing the fixed nozzle assembly and a plurality of reflection sections provided on the reflection surface along an up-down direction of the washing tub, and inclined at different angles with respect to a direction in which the washing water is sprayed from the fixed nozzle assembly. The plurality of reflection sections includes a first reflection section struck by the washing water sprayed from the fixed nozzle assembly, a second reflection section provided above the first reflection section, and configured to guide the washing water to the dishes and a third reflection section provided below the first reflection section.

An angle θ1 which the first reflection section forms with respect to the direction in which the washing water is sprayed from the fixed nozzle assembly is larger than an angle θ2 which the second reflection section forms with respect to the direction in which the washing water is sprayed from the fixed nozzle assembly, and an angle θ3 which the third reflection section forms with respect to the direction in which the washing water is sprayed from the fixed nozzle assembly.

An angle θ2 which the second reflection section forms with respect to the direction in which the washing water is sprayed from the fixed nozzle assembly is smaller than an angle θ1 which the first reflection section forms with respect to the direction in which the washing water is sprayed from the fixed nozzle assembly, and an angle θ3 which the third reflection section forms with respect to the direction in which the washing water is sprayed from the fixed nozzle assembly.

In accordance with one aspect of the present disclosure, a dishwasher includes a main body, a washing tub provided inside the main body, and configured to wash dishes therein, a fixed nozzle assembly fixed to one side of the washing tub, and configured to spray washing water, the fixed nozzle assembly including a fixed nozzle in which a spray hole is formed and a vane movably installed inside the washing tub, and configured to reflect the washing water sprayed from the spray hole of the fixed nozzle toward the dishes. The fixed nozzle includes a plurality of first spray flow paths positioned on the upstream side in a direction in which the washing water is sprayed from the fixed nozzle, a single second spray flow path positioned on the downstream in the direction in which the washing water is sprayed from the fixed nozzle and a washing water accommodating portion positioned between the plurality of first spray flow paths and the single second spray flow path so as to temporarily accommodate the washing water passed through the plurality of first spray flow paths, the washing water accommodating portion having a width that is wider than widths of the plurality of first spray flow path and the single second spray flow path.

The single second spray flow path includes a straight section having the spray hole provided at one end and a curved section connecting the other end of the straight section to the washing water accommodating portion.

A ratio between a sum L of a length L1 of the plurality of first spray flow paths in the direction in which the washing water is sprayed from the fixed nozzle, a length L2 of the washing water accommodating portion in the direction in which the washing water is sprayed from the fixed nozzle, and a length L3 of the curved section in the direction in which the washing water is sprayed from the fixed nozzle, and a width D of the washing water accommodating portion is greater than 2.

The fixed nozzle includes a guide member having the plurality of first spray flow paths formed therein and a nozzle cap in which a guide member accommodating portion in which the guide member is accommodated, the washing water accommodating portion, and the single second spray flow path are formed.

The fixed nozzle assembly further includes a casing having a flow path formed therein and a fixed nozzle coupling portion and the nozzle cap is coupled to the fixed nozzle coupling portion.

The fixed nozzle assembly further includes a casing having a flow path formed therein. The fixed nozzle further includes a guide member extending from the casing toward the vane to form the plurality of first spray flow paths therein and a nozzle cap in which a guide member accommodating portion in which the guide member is accommodated, the washing water accommodating portion, and the single second spray flow path are formed.

The fixed nozzle assembly further includes a first casing facing the vane, and a second casing coupled with the first casing so as to form a flow path therein. The fixed nozzle includes a guide member extending from the second casing toward the vane and a nozzle cap extending from the first casing toward the vane, and having a guide member accommodating portion coupled with the guide member to form the plurality of first spray flow paths.

The washing water accommodating portion and the single second spray flow path are further provided inside the nozzle cap.

In accordance with one aspect of the present disclosure, a dishwasher includes a main body, a washing tub provided inside the main body, and configured to wash dishes therein, a fixed nozzle assembly fixed to one side of the washing tub, and configured to spray washing water and a vane installed inside the washing tub in such a way to be movable along a first direction, and configured to reflect the washing water sprayed from the fixed nozzle assembly toward the dishes. The vane includes a reflection surface facing the fixed nozzle assembly and a plurality of reflection sections provided on the reflection surface along a second direction that is at right angles to the first direction, and inclined at different angles with respect to a direction in which the washing water is sprayed from the fixed nozzle assembly.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
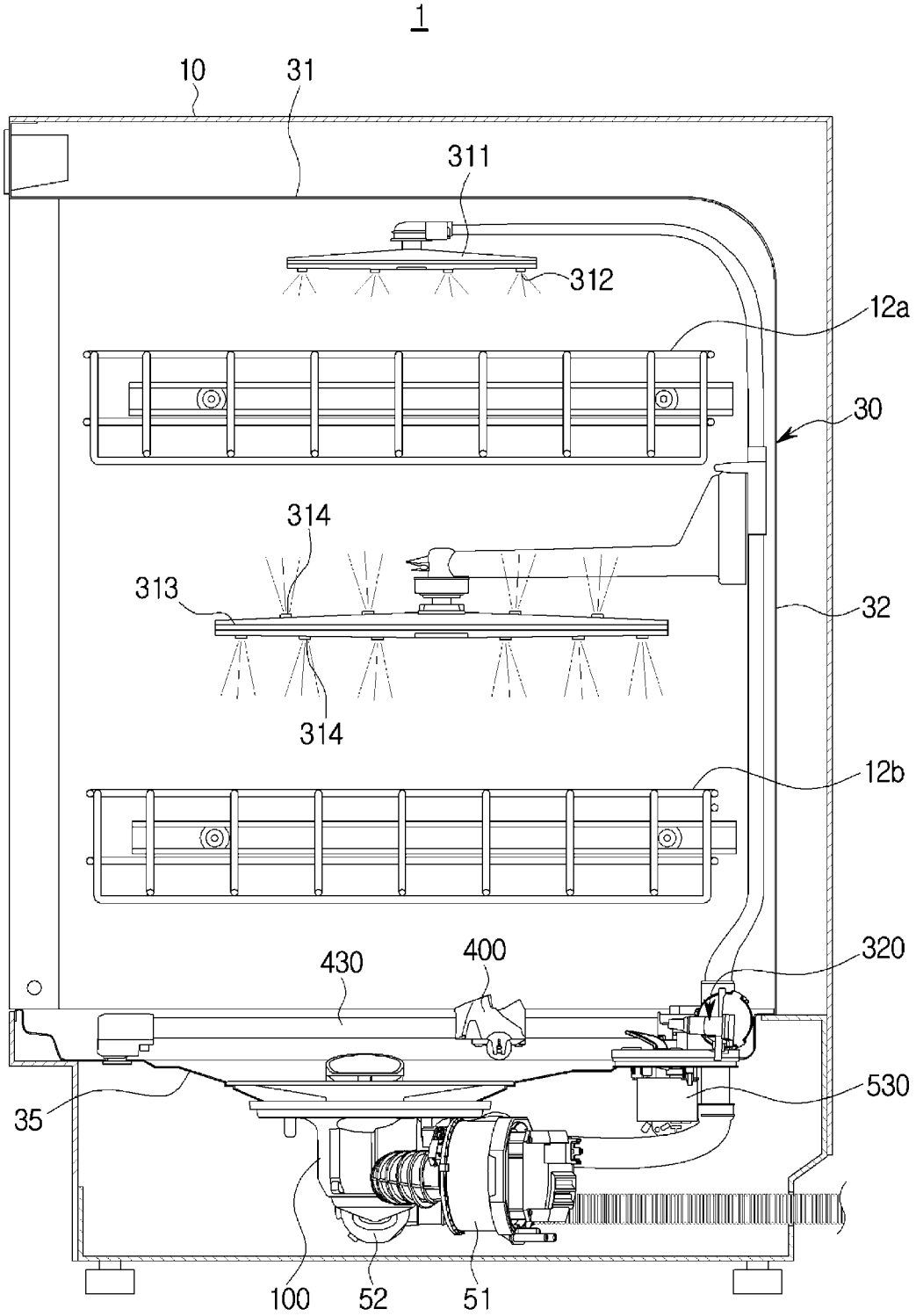
FIG. 1 is a cross-sectional view of a dishwasher in accordance with an embodiment of the present disclosure.

Reference will now be made in detail to embodiments, examples of which are illustrated in the accompanying drawings, wherein like reference numerals refer to the like elements throughout. The terms "front", "rear", "upper", "lower", "top", and "bottom" as herein used are defined with respect to the drawings, but the terms may not restrict the shape and position of the respective components.

A first direction X may be a front-rear direction of a washing tub 30, and a second direction Y may be a left-right direction of the washing tub 30. Also, a third direction Z may be an up-down direction of the washing tub 30.

Also, a first washing mode may be a normal washing mode or a full washing mode. A second washing mode may be a separate washing mode. In the first washing mode, washing water may be sprayed to all regions of the washing tub 30. In the second washing mode, the washing water may be sprayed to a region of the washing tub 30.

A fixed nozzle may include a first fixed nozzle 330, a second fixed nozzle 340, and an additional, or third, fixed nozzle 350. The first fixed nozzle 330 may include a plurality of first fixed nozzles, and the second fixed nozzle 340 may include a plurality of second fixed nozzles. The additional fixed nozzle 350 may include a plurality of additional fixed nozzles.

Hereinafter, components having the same names will be assigned the same reference numerals.

Figure 2:
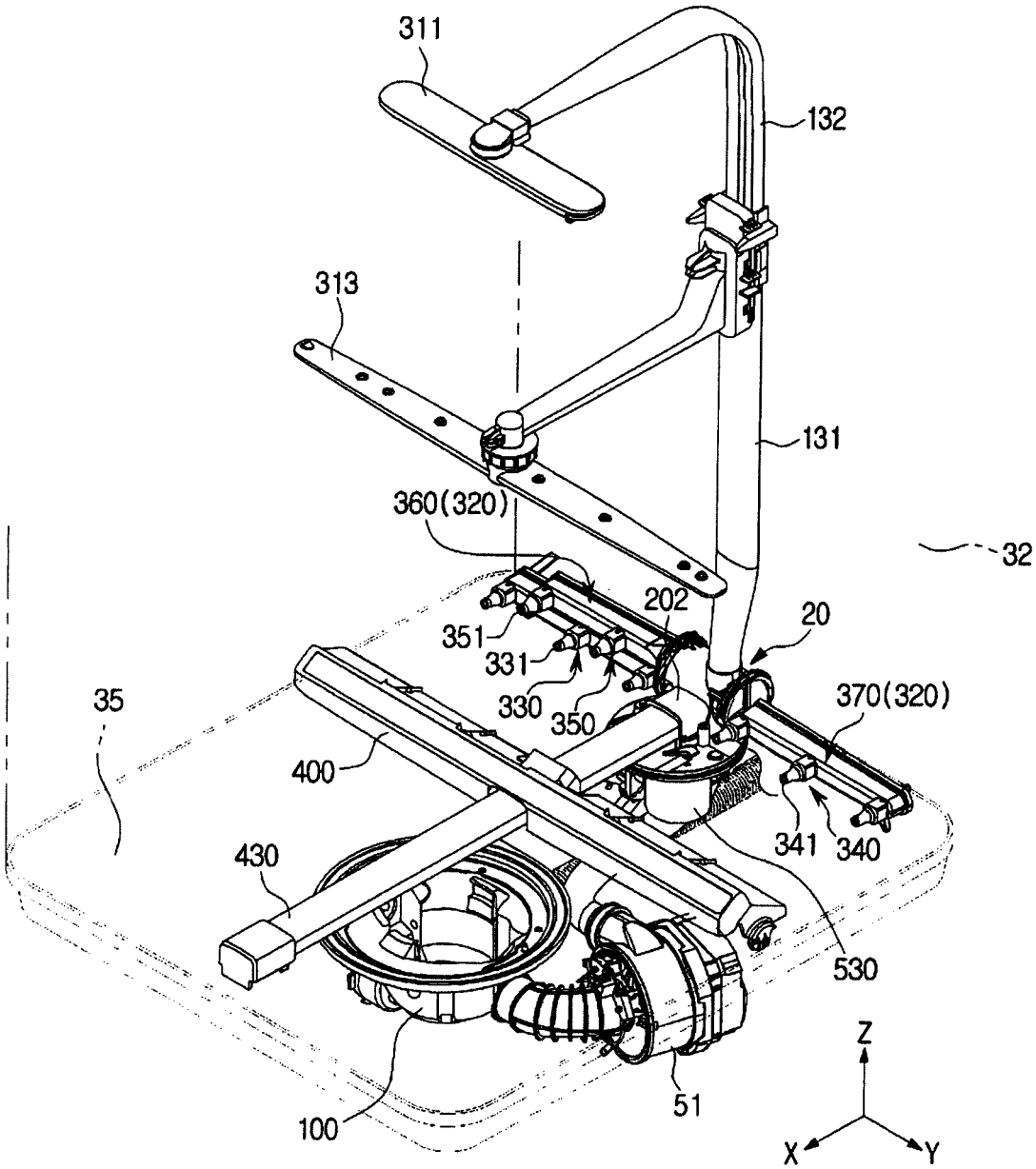
FIG. 2 is a view illustrating a flow path configuration of the dishwasher in accordance with an embodiment of the present disclosure.

FIG. 1 is a cross-sectional view of a dishwasher in accordance with an embodiment of the present disclosure, and FIG. 2 is a view illustrating a flow path configuration of the dishwasher in accordance with an embodiment of the present disclosure.

As shown in FIGS. 1 and 2, a dishwasher 1 may include a main body 10 forming the outer appearance of the dishwasher 1, a washing tub 30 provided inside the main body 10, a plurality of baskets 12*a* and 12*b* provided inside the washing tub 30 to accommodate dishes, a plurality of spray nozzles 311, 313 and 320 configured to spray washing water, a sump 100 configured to store washing water, a circulation pump 51 configured to pump washing water stored in the sump 100 and to supply the washing water to the spray nozzles 311, 313 and 320, a drain pump 52 configured to discharge washing water stored in the sump 100 to the outside of the main body 10 together with food leftovers, a vane 400 configured to move inside the washing tub 30 and to reflect washing water toward dishes, and a rail assembly 430 extending in a front-back direction and configured to slide with the vane 400 mounted thereon.

The front portion of the washing tub 30 may open to enable a user to put in or take out dishes. The front opening of the washing tub 30 may be opened or closed by a door 11. The washing tub 30 may include a top wall 31, a rear wall 32, a left wall, a right wall, and a bottom plate 35.

The baskets 12*a* and 12*b* may be wire racks formed of wires to pass washing water therethrough without collecting it therein. The baskets 12*a* and 12*b* may be removably installed in the washing tub 30. The baskets 12*a* and 12*b* may include an upper basket 12*a* disposed in the upper space of the washing tub 30, and a lower basket 12*b* disposed in the lower space of the washing tub 30.

The spray nozzles 311, 313, and 320 may spray washing water at high pressure to wash dishes. The spray nozzles 311, 313 and 320 may include an upper rotary nozzle 311 disposed in the upper portion of the washing tub 30, a middle rotary nozzle 313 disposed in the center portion of the washing tub 30, and a fixed nozzle assembly 320 disposed in the lower portion of the washing tub 30.

The upper rotary nozzle 311 may be disposed above the upper basket 12*a* to spray washing water downward while rotating by water pressure. To this end, a plurality of spray holes 312 may be formed in the lower portion of the upper rotary nozzle 311. The upper rotary nozzle 311 may directly spray washing water toward dishes accommodated in the upper basket 12*a*.

The middle rotary nozzle 313 may be disposed between the upper basket 12*a* and the lower basket 12*b* to spray washing water upward and downward while rotating by the water pressure. To this end, a plurality of spray holes 314 may be formed in the upper and lower portions of the middle rotary nozzle 313. The middle rotary nozzle 313 may directly spray washing water toward the dishes accommodated in the upper and lower baskets 12*a* and 12*b*.

Unlike the rotary nozzles 311 and 313, the fixed nozzle assembly 320 may be fixed at one side of the washing tub 30. The fixed nozzle assembly 320 may be disposed adjacent to the rear wall 32 of the washing tub 30 to spray washing water toward the front portion of the washing tub 30. Therefore, washing water sprayed from the fixed nozzle assembly 320 may not be directly directed to the dishes.

Washing water sprayed from the fixed nozzle assembly 320 may be reflected, or diverted, to the dishes by the vane 400. The fixed nozzle assembly 320 may be disposed below the lower basket 12*b*, and the vane 400 may reflect washing water sprayed from the fixed nozzle assembly 320 upward. That is, washing water sprayed from the fixed nozzle assembly 320 may be reflected to the dishes accommodated in the lower basket 12*b* by the vane 400.

The fixed nozzle assembly 320 may have a plurality of spray nozzles 360 and 370 arranged in a left-right direction in the washing tub 30. The plurality of spray nozzles 360 and 370 may spray washing water forward.

The vane 400 may be movably installed in a first direction X inside the washing tub 30 so as to reflect washing water sprayed from the fixed nozzle assembly 320 toward the dishes.

The vane 400 may extend in the left-right direction of the washing tub 30 to reflect the entire washing water sprayed from the plurality of spray nozzles 360 and 370 of the fixed nozzle assembly 320. One end of the vane 400 may be adjacent to the left wall 33 of the washing tub 30, and the other end of the vane 400 may be adjacent to the right wall 34 of the washing tub 30.

The vane 400 may be linearly reciprocated along the spray direction of washing water sprayed from the fixed nozzle assembly 320. That is, the vane 400 may be linearly reciprocated in the front-back direction of the washing tub 30 along a rail assembly 430. In other words, the vane 400 may be linearly reciprocated in the first direction X inside the washing tub 30 along the rail assembly 430.

The linear type spray structure including the fixed nozzle assembly 320 and the vane 400 may wash the entire inner area of the washing tub 30 without leaving any space which is not washed. That is, the structure is differentiated from rotary nozzles, which spray washing water only within a radius of rotation.

The fixed nozzle assembly 320 may include the first fixed nozzle 330 disposed to one side of the washing tub 30 to face the vane 400, and the second fixed nozzle 340 disposed to the other side of the washing tub 30 to face the vane 400. For example, the first fixed nozzle 330 may be disposed to the left side of the washing tub 30 in such a way to face the vane 400, and the second fixed nozzle 340 may be disposed to the right side of the washing tub 30 in such a way to face the vane 400. The second fixed nozzle 340 may be arranged in the second direction Y together with the first fixed nozzle 330. In other words, the first fixed nozzle 330 and the second fixed nozzle 340 may be arranged on a straight line extending in the second direction Y. The first direction X may be perpendicular to the second direction Y.

The fixed nozzle assembly 320 may further include the additional fixed nozzle 350 that is involved in separate washing. The additional fixed nozzle 350 may be disposed above any one of the first fixed nozzle 330 and the second fixed nozzle 340. Further, the additional fixed nozzle 350 may be involved in separate washing, together with any one of the first fixed nozzle 330 and the second fixed nozzle 340. More specifically, when the additional fixed nozzle 350 is positioned above the first fixed nozzle 330, the additional fixed nozzle 350 may be involved in separate washing that is applied to the left side of the washing tub 30, together with the first fixed nozzle 330. Meanwhile, when the additional fixed nozzle 350 is positioned above the second fixed nozzle 340, the additional fixed nozzle 350 may be involved in separate washing that is applied to the right side of the washing tub 30, together with the second fixed nozzle 340. FIG. 2 shows an embodiment in which the additional fixed nozzle 350 is positioned above the first fixed nozzle 330 so as to be involved in separate washing that is applied to the left side of the washing tub 30, together with the first fixed nozzle 330. In this case, the second fixed nozzle 340 may be involved in separate washing that is applied to the right side of the washing tub 30, independently from the first fixed nozzle 330 and the additional fixed nozzle 350.

In the case of designing the fixed nozzle assembly 320 to further include the additional fixed nozzle 350, it is possible to secure a large amount of flow and water pressure exceeding a specific level, which may lead to the improvement of washing efficiency upon separate washing. When comparing separate washing of the present disclosure in which the additional fixed nozzle 350 is used to typical separate washing in which any one of the first fixed nozzle 330 and the second fixed nozzle 340 is selectively used, the intensity of washing water used for separate washing was increased by approximately 48% compared to the typical technique, and time required to obtain the same degree of washing for dishes as the typical technique was shortened by approximately 25% compared to the typical technique.

The rotary nozzles 311 and 313 and the fixed nozzle assembly 320 may spray washing water independently. The first fixed nozzle 330 and the second fixed nozzle 340 may also spray washing water independently.

Washing water sprayed from the first fixed nozzle 330 may be reflected only to the left area of the washing tub 30 by the vane 400, and the washing water sprayed from the second fixed nozzle 340 may be reflected only to the right area of the washing tub 30 by the vane 400.

Referring to FIG. 2, washing water sprayed from the additional fixed nozzle 350 may be reflected only to the left area of the washing tub 30 by a vane 450 which will be described later.

The dishwasher 1 may wash the left and right areas of the washing tub 30 separately. The washing tub 30 may be subdivided into more areas than the left and right areas, as necessary.

The sump 100 and the spray nozzles 311, 313 and 320 may be connected by a pipe-shaped flow path 130, 131, and 132. A distributor 20 may be provided between the sump 100 and the spray nozzles 311, 313 and 320. The distributor 20 may selectively distribute washing water supplied from the sump 100 to the spray nozzles 311, 313 and 320.

The flow path 130, 131, and 132 may include a first flow path 130 connecting the sump 100 to the distributor 20 (see FIG. 3), a second flow path 131 connecting the distributor 20 to the middle rotary nozzle 313, and a third flow path 132 connecting the second flow path 131 to the upper rotary nozzle 311. The second flow path 131 and the third flow path 132 may be formed as a single tube. A first fixed nozzle unit 360 provided with the first fixed nozzle 330 and a second fixed nozzle unit 370 provided with the second fixed nozzle 340 may be directly connected to the left and right sides of the distributor 20, respectively.

Another distributor (not shown) may be further provided between the second flow path 131 and the third flow path 132. Washing water that entered the second flow path 131 by the distributor positioned between the second flow path 131 and the third flow path 132 may be sprayed through the middle rotary nozzle 313, or may move to the third flow path 132. That is, the distributor positioned between the second flow path 131 and the third flow path 132 may close the third flow path 132 to cause washing water that entered the second flow path 131 to be sprayed through the middle rotary nozzle 313. Or, the distributor positioned between the second flow path 131 and the third flow path 132 may close a connection part between the second flow path 131 and the middle rotary nozzle 313 to cause the entire washing water that entered the second flow path 131 to flow to the third flow path 132. Further, the distributor may open both the middle rotary nozzle 313 and the third flow path 132 so that washing water is sprayed from both the middle rotary nozzle 313 and the upper rotary nozzle 311.

The second flow path 131 and the third flow path 132 may be positioned adjacent to the rear wall 32 of the washing tub 30 so as not to be interfered by the baskets 12*a* and 12*b*. The second flow path 131 and the third flow path 132 may be adjacent to the rear wall 32, and extend vertically.

The distributor 20 may be positioned behind the sump 100 in the main body 10. The distributor 20 may be positioned adjacent to the rear wall 32. The distributor 20 may be positioned below the second flow path 131, and may be in alignment with the fixed nozzle assembly 320. The distributor 20 may be positioned between the first fixed nozzle unit 360 and the second fixed nozzle unit 370. Also, the distributor 20 may be positioned below the second flow path 131 in such a way to be substantially in alignment with the second flow path 131.

The sump 100 may be positioned below the bottom plate 35, outside the washing tub 30. However, the distributor 20 may be positioned above the bottom plate 35, inside the washing tub 30. A rail mounting portion 202 on which the rail assembly 430 for guiding the movement of the vane 400 is mounted may be provided on one side of the distributor 20. The rail assembly 430 may be positioned adjacent to the bottom plate 35 in such a way to extend in the front-rear direction in the washing tub 30.

A motor assembly 530 may be provided on another side of the distributor 20. The motor assembly 530 may include a motor to provide a driving force for moving the vane 400 backward. The rail assembly 430 may be provided with a moving device to move the vane 400 by receiving the driving force of the motor.

The motor assembly 530 may include a case 531 having space in which the motor is accommodated, and a cover 532 to cover one side of the case 531. The upper portion of the case 531 may open, and the cover 532 may cover the opened portion. The distributor 20 may be mounted on the cover 532. A case 21 of the distributor 20 may be integrated into the cover 532.

The distributor 20 may open at least one of the first fixed nozzle unit 360, the second fixed nozzle unit 370, and the second flow path 131 by receiving the driving force from a motor 534. Water supplied from the sump 100 may be sprayed by the distributor 20 through the fixed nozzle assembly 320, or may be sprayed through the middle rotary nozzle 313 or the upper rotary nozzle 311. Further, only one of the first fixed nozzle 330 and the second fixed nozzle 340 may be opened by the distributor 20. Further, only one(s) of the first fixed nozzle 330 and the additional fixed nozzle 350, and the second fixed nozzle 340 may be opened by the distributor 20. The additional fixed nozzle 350 may be opened by the distributor 20 to be involved in separate washing. That is, washing water may be sprayed from one of the first fixed nozzle 330 and the second fixed nozzle 340 by the distributor 20. Or, washing water may be sprayed from one(s) of the first fixed nozzle 330 and the additional fixed nozzle 350, and the second fixed nozzle 340 by the distributor 20. Or, washing water may be sprayed from both the first fixed nozzle 330 and the second fixed nozzle 340.

Hereinafter, the courses and flow path structure of the dishwasher according to an embodiment of the present disclosure, the structure of the fixed nozzle assembly, and a structure of distributing washing water will be described.

The dishwasher may include a water feeding course, a washing course, a drainage course, and a drying course.

In the water feeding course, washing water may be fed into the washing tub 30 through a water feed pipe (not shown). The washing water fed into the washing tub 30 may flow downward by the gradient of the bottom plate 35 of the washing tub 30 to be stored in the sump 100 provided below the washing tub 30.

In the washing course, the circulation pump 51 may operate to pump the washing water stored in the sump 100. The washing water pumped by the circulation pump 51 may be distributed to the rotary nozzles 311 and 313, the first fixed nozzle 330, the second fixed nozzle 340, and the additional fixed nozzle 350 through the distributor 20. By the pumping force of the circulation pump 51, the washing water may be sprayed at high pressure from the spray nozzles 311, 313, and 320 so as to wash the dishes.

The upper rotary nozzle 311 and the middle rotary nozzle 313 may receive washing water through the second flow path 131 or the third flow path 132. Washing water flowing into the second flow path 131 by the distributor 20 may flow into the middle rotary nozzle 313 by another distributor positioned at the second flow path 131. Or, the washing water flowing into the second flow path 131 by the distributor 20 may flow into the upper rotary nozzle 311 through the third flow path 132. The washing water flowed into the second flow path 131 may be sprayed through both the middle rotary nozzle 313 and the upper rotary nozzle 311.

The distributor 20 may cause washing water to be sprayed from the entire fixed nozzle assembly 320. Or, the distributor 20 may cause washing water to be sprayed through one of the first fixed nozzle 330 and the second fixed nozzle 340. Or, the distributor 20 may cause washing water to be sprayed through one(s) of the first fixed nozzle 330 and the additional fixed nozzle 350, and the second fixed nozzle 340.

The distributor 20 may open at least one of the fixed nozzle assembly 320 and the second flow path 131. By an operation of the distributor 20, washing water pumped by the sump 100 may flow into only the fixed nozzle assembly 320, into only the second flow path 131, or into both the fixed nozzle assembly 320 and the second flow path 131.

The distributor 20 may be provided with more various distribution modes than in the example described above.

Washing water sprayed from the spray nozzles 311, 313, and 320 may strike dishes, remove food leftovers remaining on the dishes, drop together with the food leftovers, and then be stored in the sump 100 again. The circulation pump 51 may pump and circulate the washing water stored in the sump 100 again. During the washing course, the circulation pump 51 may operate and stop repeatedly. In this process, the food leftovers dropped onto the sump 100 together with the washing water may be collected by a filter mounted on the sump 100 to remain in the sump 100 without being circulated to the spray nozzles 311, 313, and 320.

In the drainage course, the drain pump 52 may operate to drain the food leftovers and the washing water remaining in the sump 100 to the outside of the main body 10.

In the drying course, a heater (not shown) installed in the washing tub 30 may operate to dry the dishes.

Figure 3:
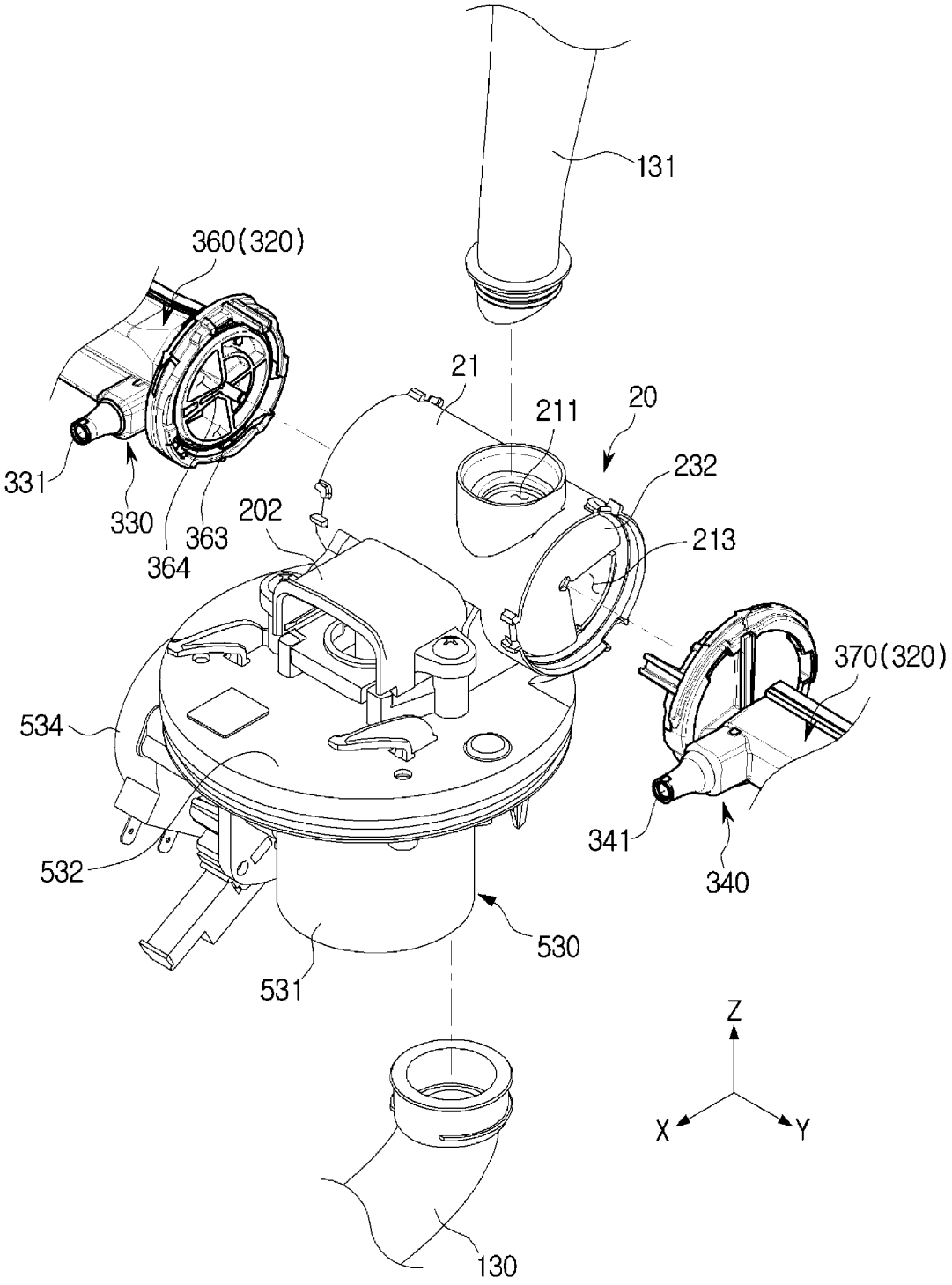
FIG. 3 is a perspective view illustrating the distributor of the dishwasher in accordance with an embodiment of the present disclosure.
Figure 4:
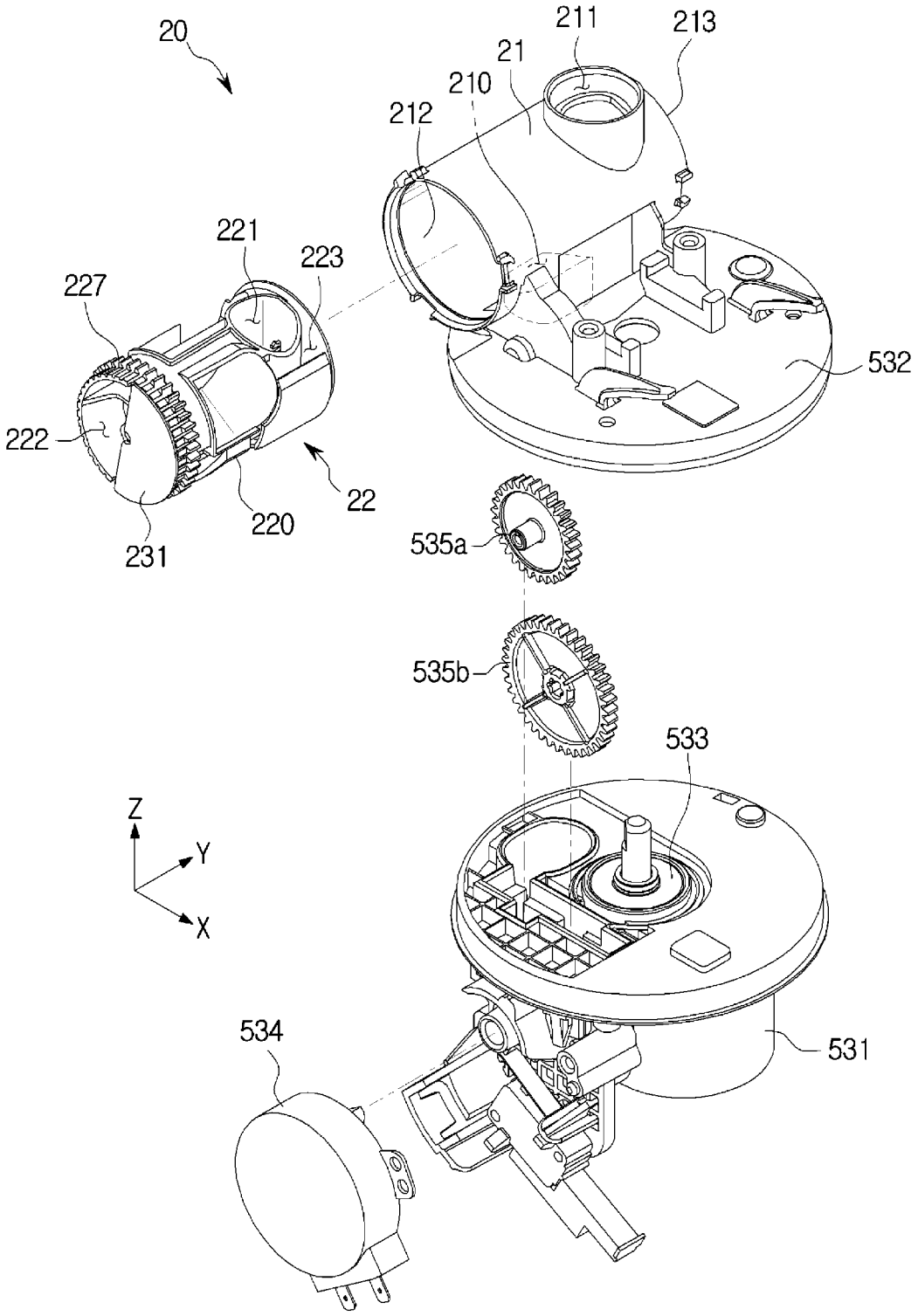
FIG. 4 is an exploded perspective view illustrating the distributor of the dishwasher in accordance with an embodiment of the present disclosure.
Figure 5:
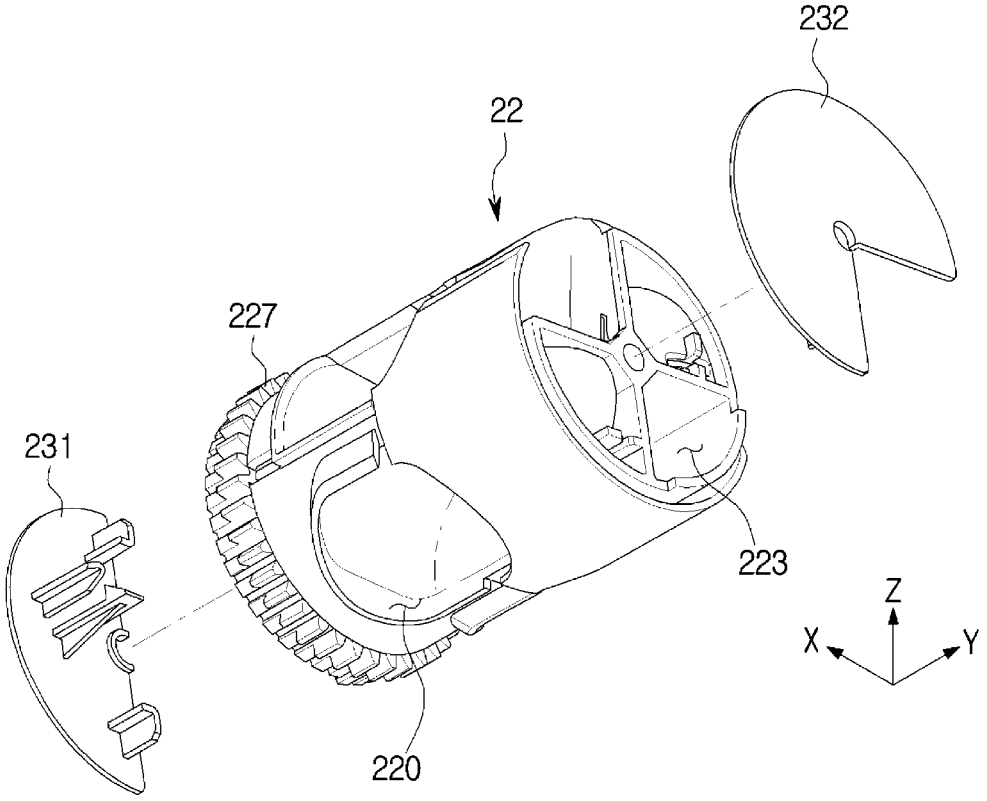
FIG. 5 is a perspective view illustrating a rotating member equipped in the distributor of the dishwasher in accordance with an embodiment of the present disclosure.

FIG. 3 is a perspective view illustrating the distributor of the dishwasher in accordance with an embodiment of the present disclosure, and FIG. 4 is an exploded perspective view illustrating the distributor of the dishwasher in accordance with an embodiment of the present disclosure. FIG. 5 is a perspective view illustrating a rotating member equipped in the distributor of the dishwasher in accordance with an embodiment of the present disclosure.

As shown in FIGS. 3 to 5, the distributor 20 may include the case 21, and a rotating member 22 rotatably provided in the case 21. The rotating member 22 may rotate by receiving a driving force from the motor 534. The case 21 and the rotating member 22 may be provided in a substantially cylindrical shape. However, the shapes of the case 21 and the rotating member 22 may not be limited to the cylindrical shape.

The case 21 may include an inlet 210 connected to the first flow path 130 connected to the sump 100. Washing water stored in the sump 100 may be pumped by the circulation pump 51 and fed into the case 21 through the inlet 210. The case 21 may be further provided with a first outlet 211 corresponding to the second flow path 131, a second outlet 212 corresponding to the first fixed nozzle 330, and a third outlet 213 corresponding to the second fixed nozzle 340.

The inlet 210 and the first outlet 211 may be disposed in one side of the case 21 and another side of the case 21, respectively, in such a way to face each other. Further, the second outlet 212 and the third outlet 213 may be positioned on a straight line extending in the second direction Y formed by the first fixed nozzle 330 and the second fixed nozzle 340.

When the case 21 is provided in a cylindrical shape, the inlet 210 and the first outlet 211 may be formed in the side of the case 21 that is curved. Also, the second outlet 212 and the third outlet 213 may be respectively formed in the upper and lower portions of the case 21 that are flat.

The rotating member 22 may be rotatably accommodated in the case 21. In one side of the rotating member 22, a flow path inlet 220 corresponding to the inlet 210 formed in the case 21 may be formed.

The rotating member 22 may include a first flow path outlet 221 at a position facing the flow path inlet 220. The first flow path outlet 221 may correspond to the first outlet 211 provided in the case 21. The flow path inlet 220 may communicate with the first flow path outlet 221. A flow path through which the flow path inlet 220 is connected to the first flow path outlet 221 will be referred to as a first connection flow path.

The flow path inlet 220 provided in the rotating member 22 and the inlet 210 provided in the case 21 may have different sizes and shapes. Also, the first flow path outlet 221 provided in the rotating member 22 and the first outlet 211 formed in the case 21 may have different sizes, different shapes, and different positions.

Therefore, even if the flow path inlet 220 provided in the rotating member 22 communicates with the inlet 210 provided in the case 21, washing water flowing into the rotating member 22 through the inlet 210 and the flow path outlet 220 may pass through the first outlet 211 and the first flow path outlet 221 or may not pass through the first outlet 211 and the first flow path outlet 221 according to the position of the rotating member 22 in the case 21.

The rotating member 22 may be provided with a second flow path outlet 222 and a third flow path outlet 223 corresponding to the second outlet 212 and the third outlet 213 of the case 21, respectively. The second flow path outlet 222 may face the third flow path outlet 223.

The flow path inlet 220 may communicate with the second flow path outlet 222 through a second connection flow path. The flow path inlet 220 may communicate with the third flow path outlet 223 through a third connection flow path.

The first connection flow path, the second connection flow path, and the third connection flow path may be provided as separate independent flow paths without being connected to each other. For example, the first connection flow path may extend to the upper portion where the first flow path outlet 221 is positioned, the second connection flow path may extend to the left portion where the first fixed nozzle 330 is positioned, and the third connection flow path may extend to the right portion where the second fixed nozzle 340 is positioned.

When the rotating member 22 is provided in a cylindrical shape, the flow path inlet 220 and the first flow path outlet 221 may be formed in the side of the rotating member 22 that is curved. The second flow path outlet 222 and the third flow path outlet 223 may be formed at positions corresponding to the upper and lower portions of the cylinder, respectively.

The first flow path outlet 221 may face the third flow path outlet 223, and the first flow path outlet 221 and the third flow path outlet 223 may have different sizes or shapes. Therefore, when washing water entered the distributor 20 is discharged to the first fixed nozzle 330 through the first flow path outlet 221 provided in the rotating member 22 and the first outlet 212 provided in the case 21, the washing water may be discharged to both the first fixed nozzle 330 and the second fixed nozzle 340 through the second flow path outlet 223 and the first outlet 213 or may be discharged to only the first fixed nozzle 330 according to the position of the rotating member 22.

As described above, the single rotating member 22 may be connected to a plurality of flow paths by a plurality of internal flow paths provided independently. The single rotating member 22 may control the flow of washing water to at least some of the plurality of flow paths. Since flow paths are opened or closed by a single rotating member, a flow path structure provided in the dishwasher can be simplified.

Cap members 231 and 232 may be mounted on both side surfaces of the rotating member 22. The cap members 231 and 232 may include a first cap member 231 provided on one surface where the second flow path outlet 222 is formed, and a second cap member 232 provided on the other surface where the third flow path outlet 223 is formed. The first cap member 231 and the second cap member 232 may be formed in the shape of a thin plate, and may be come into close contact with the second flow path outlet 222 or the third flow path outlet 223 by water pressure. The cap members 231 and 232 may prevent leakage of water from a connection portion between the distributor 20 and the fixed nozzle assembly 320.

In other words, the cap members 231 and 232 may control the flow of washing water into the fixed nozzle assembly 320 by rotating together with the rotating member 22. That is, the cap members 231 and 232 may control the flow of washing water into the first fixed nozzle 330, the second fixed nozzle 340, and the additional fixed nozzle 350 by rotating together with the rotating member 22. More specifically, the first cap member 231 may be coupled to one surface of the rotating member 23 so as to open or close a plurality of communication portions 363 and 364 of the first fixed nozzle unit 360 by rotating together with the rotating member 23. The second cap member 232 may be coupled to the other surface of the rotating member 22 so as to open or close an opening 373 of the second fixed nozzle unit 370 by rotating together with the rotating member 22. Details about the operation of the cap members 231 and 232 for controlling the flow of washing water into the fixed nozzle assembly 320 will be described later.

In the above description, the cap members 231 and 232 are provided on both side surfaces of the rotating member 22, however, cap members may be further provided between the flow path outlet provided in the rotating member 22 and the flow path connected to the rotating member.

In one side of the rotating member 22, a driving force transmitting portion for receiving the driving force of the motor 534 may be provided. For example, the driving force transmitting portion may be a gear portion 227 provided on one side of the rotating member 22. Hereinafter, an embodiment in which the driving force transmitting portion is the gear portion 227 will be described.

Figure 6:
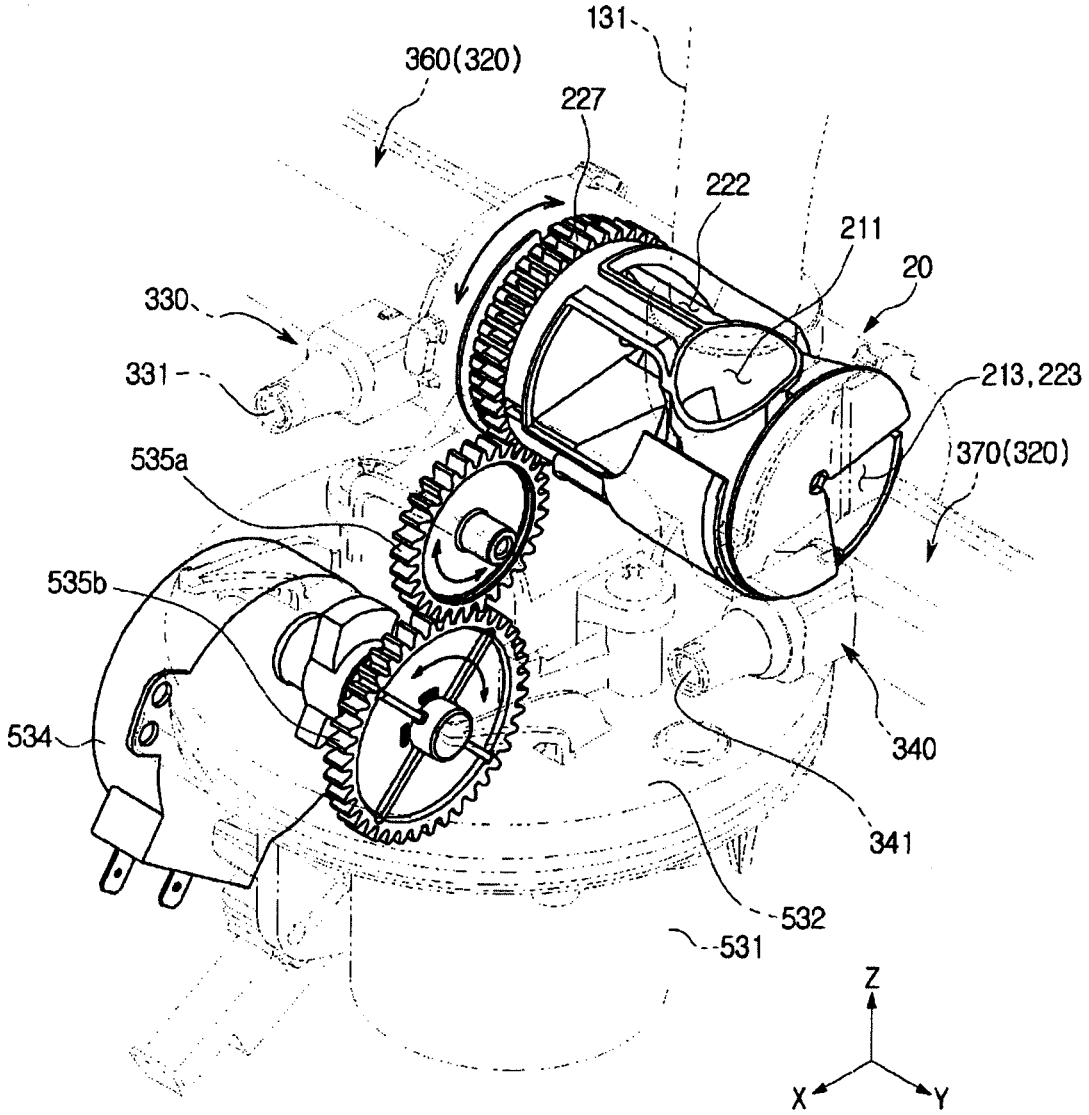
FIG. 6 shows the inner configuration of the distributor of the dishwasher in accordance with an embodiment of the present disclosure.

FIG. 6 shows the inner configuration of the distributor of the dishwasher in accordance with an embodiment of the present disclosure.

As shown in FIG. 6, the distributor 20 may receive the driving force of the motor 534 to rotate the rotating member 22 in the case 21, thereby selectively opening or closing the flow paths. The rotating member 22 may be gear-connected to the motor 534. That is, the driving force of the motor 534 may be transmitted to the rotating member 22 through a plurality of gears connected to the motor 534.

For example, a gear portion 227 may be provided at one side of the rotating member 22. A driving gear 535*b* may be connected to a rotating shaft (not shown) of the motor 534, and a connecting gear 535*a* may be engaged with the driving gear 535*b*. The connecting gear 535*a* may be engaged with the gear portion 227. The driving force of the motor 534 may be transmitted to the rotating member 22 through the driving gear 535*b*, the connecting gear 535*a*, and the gear portion 227. The gear portion 227 may be integrated into the rotating member 22.

The connecting gear 535 may rotate in a clockwise or counterclockwise direction by the driving force of the motor 534. The rotating member 22 may rotate in the clockwise or counterclockwise direction by receiving the driving force through the gear portion 227 engaged with the connecting gear 535 and the connecting gear 535. Thus, the rotating member 22 may rotate in the clockwise or counterclockwise direction to selectively open or close the second flow path 131, the first fixed nozzle 330, the second fixed nozzle 340, and the additional fixed nozzle 350.

The driving force of the motor 534 may be more accurately transmitted to the rotating member 22 by a gear connection. The driving force of the motor 534 can be more accurately transmitted by the gear connection than by another connecting structure, such as a pulley, a belt structure, and the like. By receiving the driving force by the gear connection, the rotation angle and rotation speed of the rotating member 22 can be controlled according to setting information. The rotating member 22 may accurately perform operation of opening or closing flow paths so as to open only a path(s) selected according to the setting information.

Figure 7:
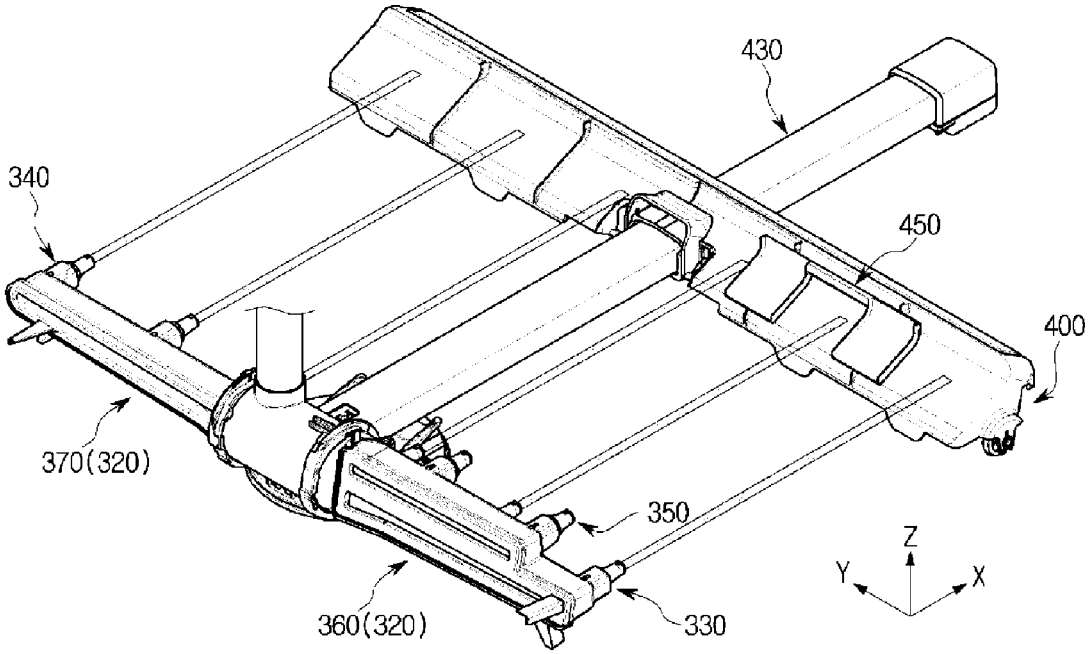
FIG. 7 is a view schematically illustrating an aspect in which washing water is sprayed in a first washing mode of the dishwasher in accordance with an embodiment of the present disclosure.
Figure 8:
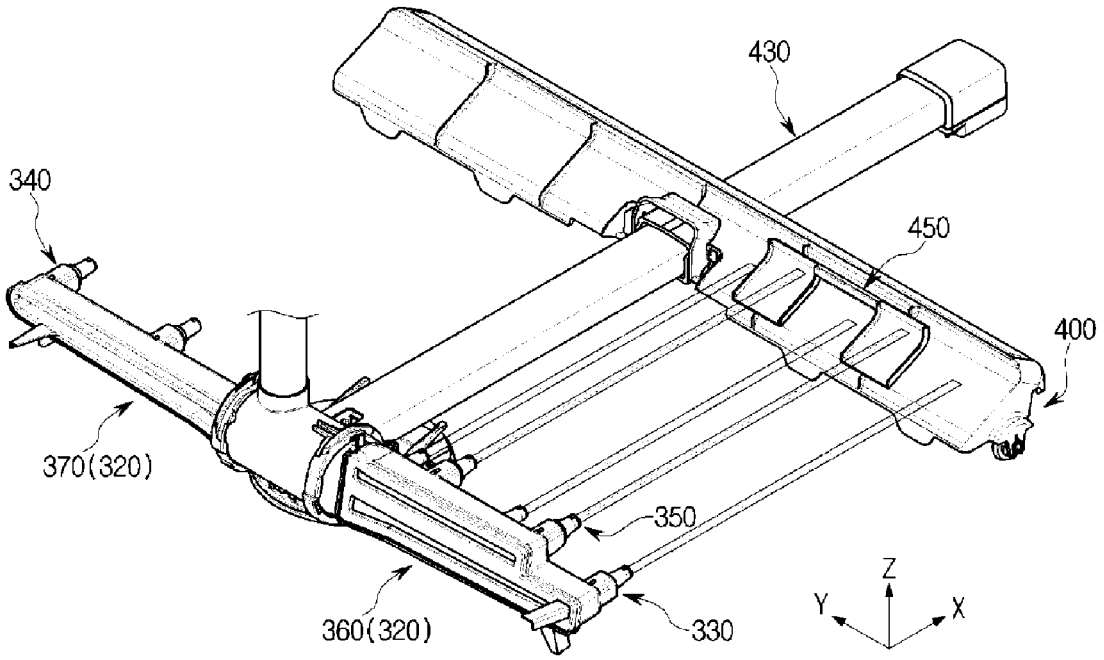
FIG. 8 is a view schematically illustrating an aspect in which washing water is sprayed in a second washing mode of the dishwasher in accordance with an embodiment of the present disclosure.

FIG. 7 is a view schematically illustrating an aspect in which washing water is sprayed in a first washing mode of the dishwasher in accordance with an embodiment of the present disclosure, and FIG. 8 is a view schematically illustrating an aspect in which washing water is sprayed in a second washing mode of the dishwasher in accordance with an embodiment of the present disclosure.

As shown in FIG. 7, in the first washing mode, washing water may be sprayed to the entire area of the washing tub 30. That is, in the first washing mode, washing water may be sprayed to the entire area of the washing tub 30 through the first fixed nozzle 330 and the second fixed nozzle 340. The washing water sprayed from the first fixed nozzle 330 and the second fixed nozzle 340 may collide with the vane 400 to be reflected onto dishes.

As shown in FIG. 8, in the second washing mode, the washing water may be sprayed only to a part of the washing tub 30. That is, in the second washing mode, washing water may be sprayed to a part of the washing tub 30 through the first fixed nozzle 330 and the additional fixed nozzle 350. Referring to FIG. 8, in the second washing mode, washing water may be sprayed to the right area of the washing tub 30 through the first fixed nozzle 330 and the additional fixed nozzle 350. At this time, washing water sprayed from the first fixed nozzle 330 may collide with the vane 400 to be reflected onto the dishes, and washing water sprayed from the additional fixed nozzle 350 may collide with the additional vane 450 to be reflected onto the dishes.

FIG. 8 illustrates the second washing mode in which washing water is sprayed to the right area, but in the second washing mode, washing water may be sprayed to the left area. The second washing mode in which washing water is sprayed to the left area will be described as follows.

In the second washing mode, washing water may be sprayed to a part of the washing tub 30 through the second fixing nozzle 340. In the second washing mode, the washing water may be sprayed to the left area through the second fixed nozzle 340. At this time, the washing water sprayed from the second fixed nozzle 340 may collide with the vane 400 to be reflected to the dishes.

Figure 9:
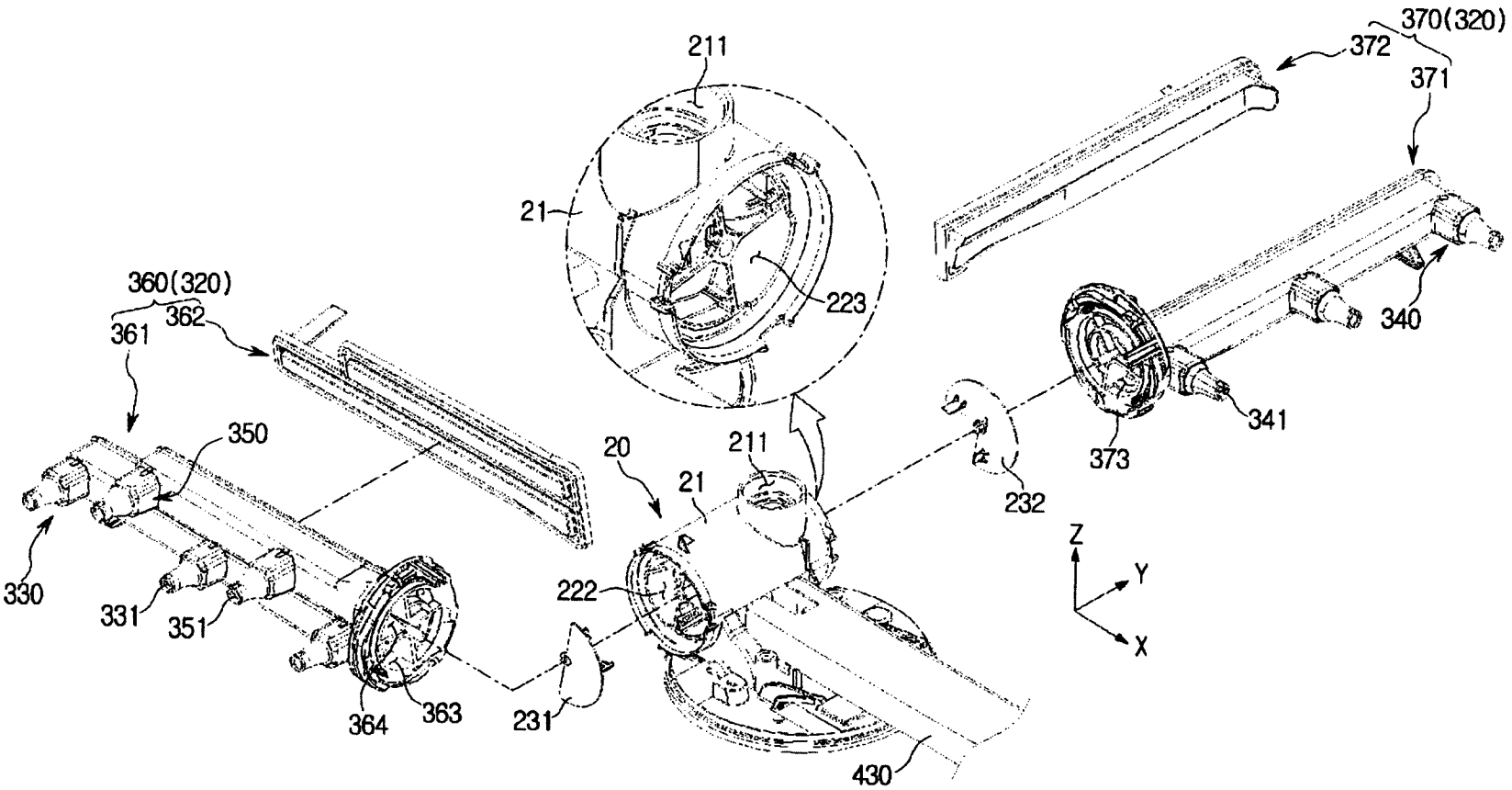
FIG. 9 is an exploded perspective view illustrating a fixed nozzle assembly of the dishwasher in accordance with an embodiment of the present disclosure.

FIG. 9 is an exploded perspective view illustrating a fixed nozzle assembly of the dishwasher in accordance with an embodiment of the present disclosure.

As shown in FIG. 9, the fixed nozzle assembly 320 may include the first fixed nozzle unit 360 and the second fixed nozzle unit 370. The first fixed nozzle unit 360 and the second fixed nozzle unit 370 may be disposed on a straight line extending in the second direction Y. The distributor 20 may be disposed between the first fixed nozzle unit 360 and the second fixed nozzle unit 370. The first fixed nozzle unit 360 may be coupled to one side of the distributor 20 in which the second flow path outlet 222 is formed. The second fixed nozzle unit 370 may be coupled to the other side of the distributor 20 in which the third flow path outlet 223 is formed.

The first fixed nozzle unit 360 may include casings 361 and 362 forming the external appearance. The casings 361 and 362 may include a first casing 361 facing the vane 400, and a second casing 362 coupled to the first casing 361 to form a flow path therein. The first fixed nozzle 330 and the additional fixed nozzle 350 may be formed in the first casing 361. The additional fixed nozzle 350 may be formed in the first casing 361 to be positioned above the first fixed nozzle 330 in the third direction Z. The first fixed nozzle 330 and the additional fixed nozzle 350 may be formed in the first casing 361 such that respective spray holes 331 and 351 face the vane 400.

The first fixed nozzle unit 360 may further include a plurality of communication portions 363 and 364. The plurality of communication portions 363 and 364 may be opened or closed by the first cap member 231 rotating together with the rotating member 22. The plurality of communication portions 363 and 364 may be formed at one end of the casings 361 and 362 facing the distributor 20 so as to be opened or closed by the first cap member 231. More specifically, the plurality of communication portions 363 and 364 may be formed on one surface of the first casing 361 facing the distributor 20 so as to be opened or closed by the first cap member 231. Washing water discharged through the second flow path outlet 222 may flow into the first fixed nozzle unit 360 through the plurality of communication portions 363 and 364.

The plurality of communication portions 363 and 364 may include a first communication portion 363 communicating with the first fixed nozzle 330, and a second communication portion 364 communicating with the additional fixed nozzle 350. The second communication portion 364 may be positioned above the first communication portion 363 in the third direction Z.

The second fixed nozzle unit 370 may include casings 371 and 372 forming the external appearance. The casings 371 and 372 may include a first casing 371 facing the vane 400, and a second casing 372 coupled to the first casing 371 to form a flow path therein. The second fixed nozzle 340 may be formed in the first casing 371. The second fixed nozzle 340 may be formed in the first casing 371 such that a spray hole 341 faces the vane 400.

The second fixed nozzle unit 370 may include the opening 373. The opening 373 may be opened or closed by the second cap member 232 rotating together with the rotating member 22. The opening 373 may be formed at one end of the casings 371 and 372 facing the distributor 20 so as to be opened or closed by the second cap member 232. More specifically, the opening 373 may be formed in one side of the first casing 371 facing the distributor 20 so as to be opened or closed by the second cap member 232. Washing water discharged through the third flow path outlet 223 may pass through the opening 373 to flow into the second fixed nozzle unit 370.

Figure 10A:
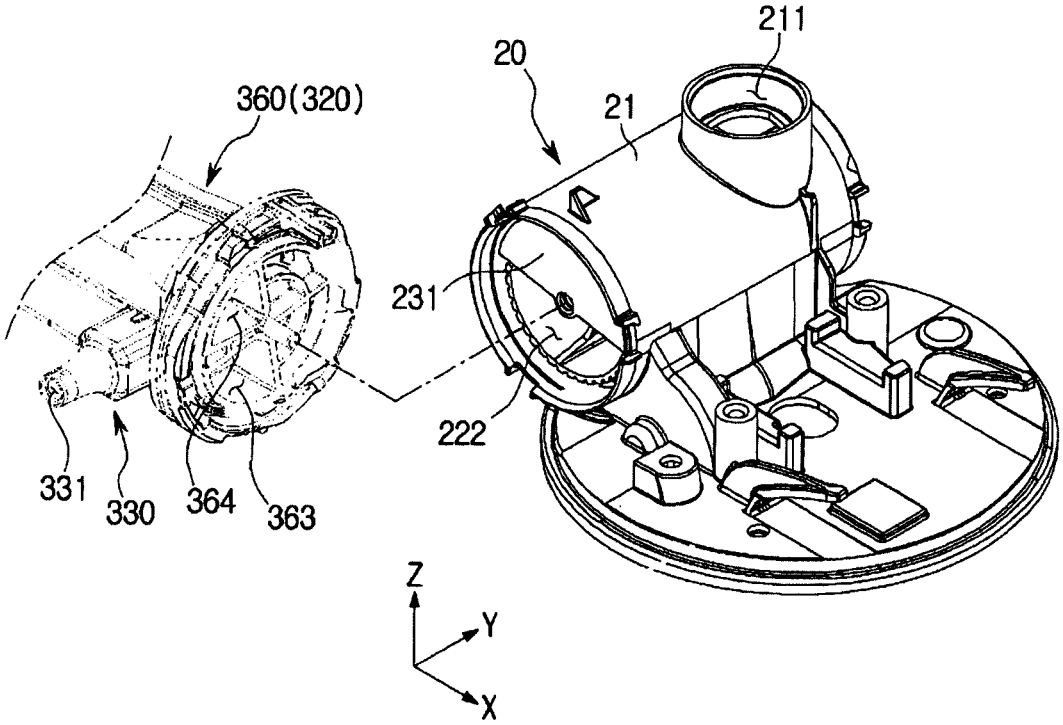
FIGS. 10A and 10B are views illustrating a state of a cap member in the first washing mode of the dishwasher in accordance with an embodiment of the present disclosure.
Figure 10B:
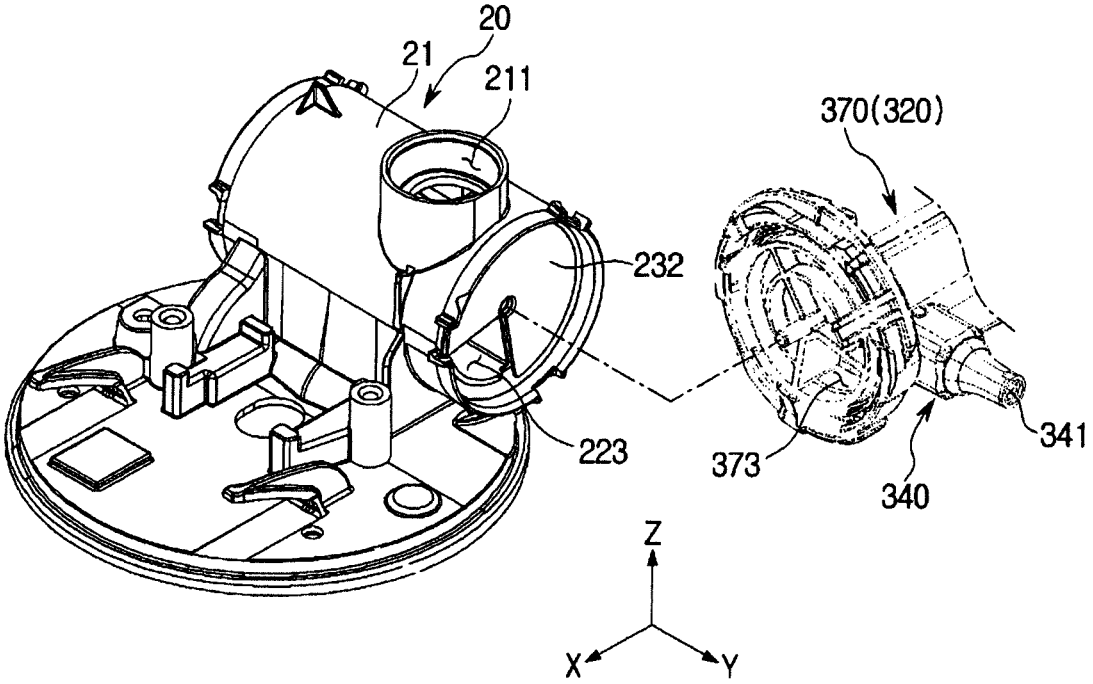

FIGS. 10A and 10B are views illustrating a state of a cap member in the first washing mode of the dishwasher in accordance with an embodiment of the present disclosure. FIG. 10A is a view illustrating a state of the first cap member 231 in the first washing mode, and FIG. 10B is a view illustrating a state of the second cap member 232 in the first washing mode.

As described above, in the first washing mode, the first fixed nozzle 330 and the second fixed nozzle 340 may be used.

As shown in FIG. 10A, the first cap member 231 may open the first communicating portion 363 communicating with the first fixed nozzle 330, and close the second communicating portion 364 communicating with the additional fixed nozzle 350. Accordingly, washing water discharged through the second flow path outlet 222 may pass through the first communicating portion 363 to be supplied to the first fixed nozzle 330.

As shown in FIG. 10B, the second cap member 232 may open the opening 373 communicating with the second fixed nozzle 340. Accordingly, washing water discharged through the third flow path outlet 223 may pass through the opening 373 to be supplied to the second fixed nozzle 340.

Figure 11A:
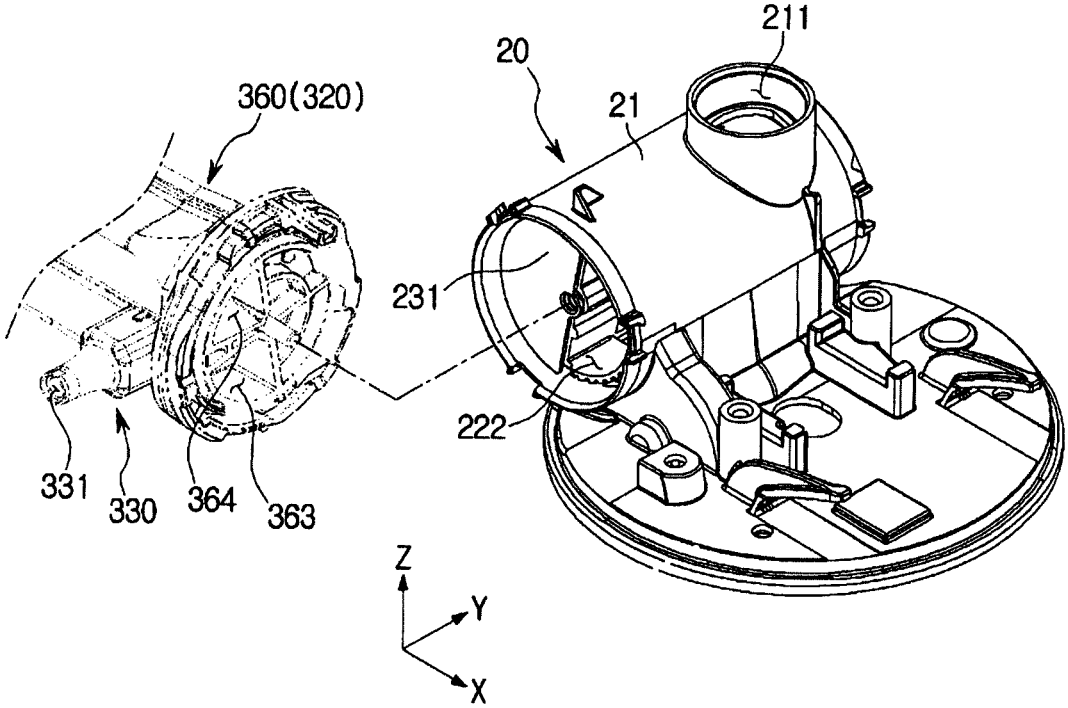
FIGS. 11A and 11B are views illustrating a state of the cap member in the second washing mode of the dishwasher in accordance with an embodiment of the present disclosure.
Figure 11B:
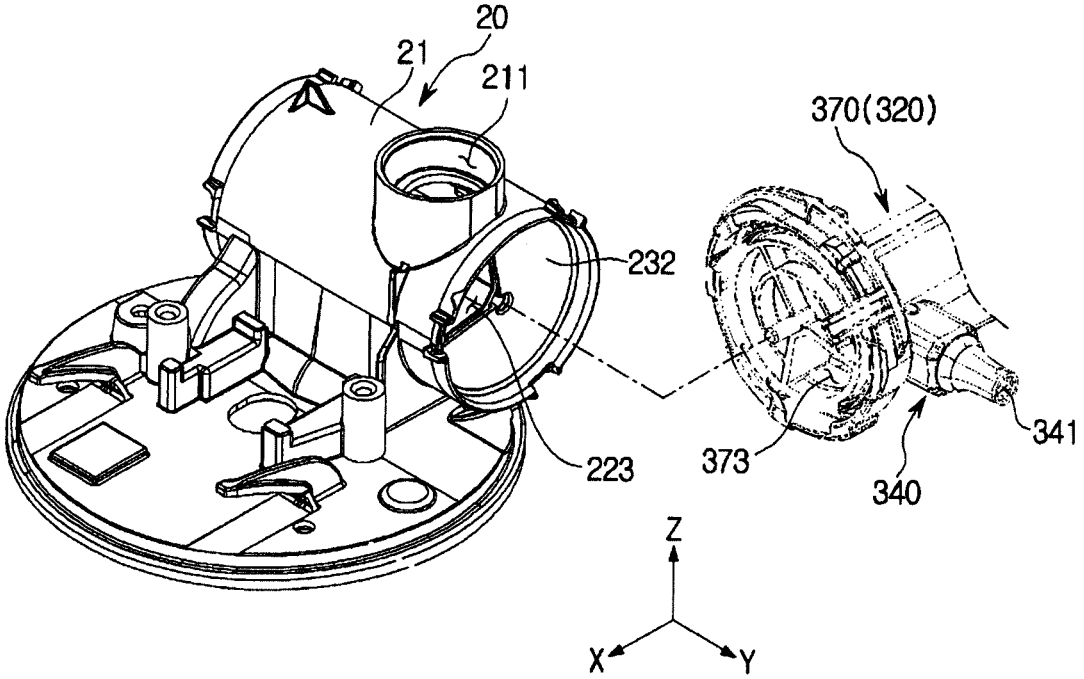

FIGS. 11A and 11B are views illustrating a state of the cap member in the second washing mode of the dishwasher in accordance with an embodiment of the present disclosure. FIG. 11A is a view illustrating a state of the first cap member 231 in the second washing mode, and FIG. 11B is a view illustrating a state of the second cap member 232 in the second washing mode. FIGS. 11A and 11B are views illustrating the second washing mode in which the first fixed nozzle 330 and the additional fixed nozzle 350 are involved.

As shown in FIG. 11A, the first cap member 231 may open both the first communicating portion 363 communicating with the first fixed nozzle 330, and the second communicating portion 364 communicating with the additional fixed nozzle 350. Accordingly, washing water discharged through the second flow path outlet 222 may pass through the first communicating portion 363 to be supplied to the first fixed nozzle 330, and pass through the second communicating portion 364 to be supplied to the additional fixed nozzle 350.

As shown in FIG. 11B, the second cap member 232 may close the opening 373 communicating with the second fixed nozzle 340. Accordingly, washing water discharged through the third flow path outlet 223 may not pass through the opening 373 so as not to be supplied to the second fixed nozzle 340.

Figure 12:
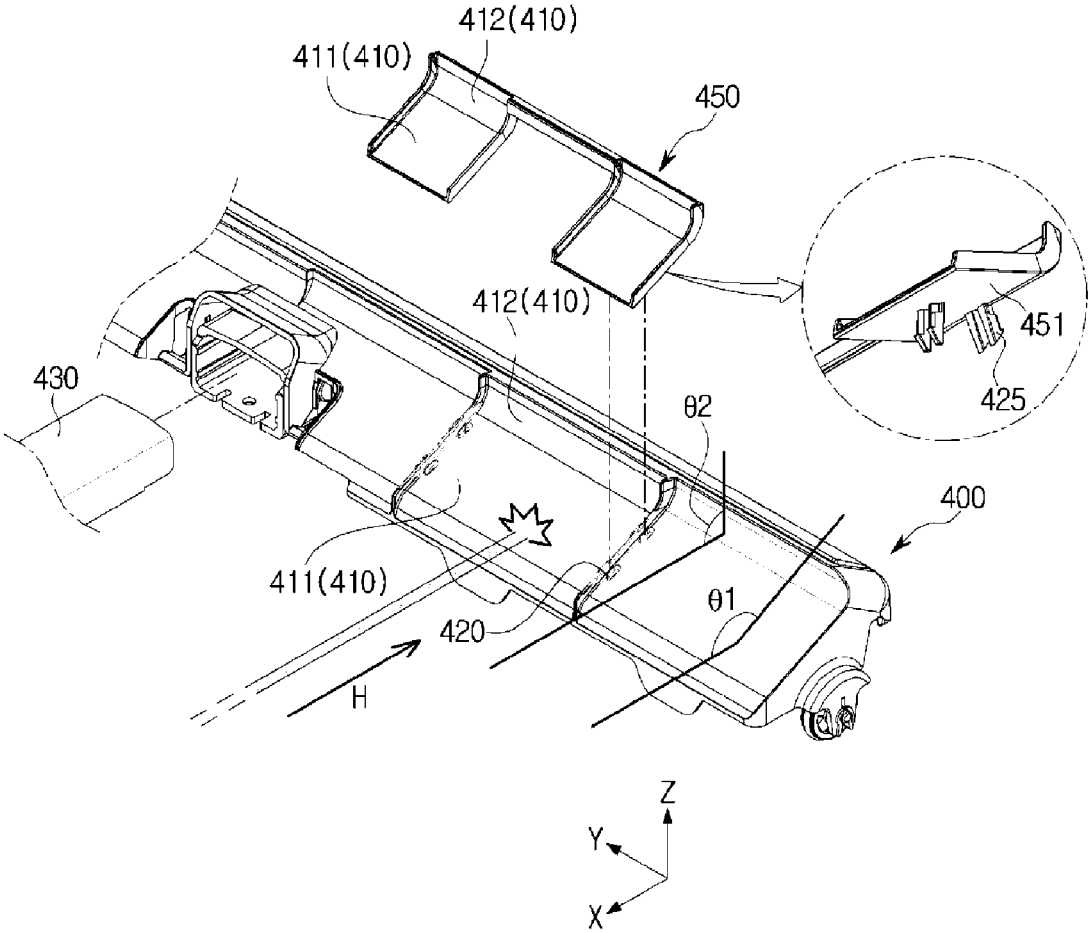
FIG. 12 is an enlarged exploded perspective view of the vane of the dishwasher in accordance with an embodiment of the present disclosure.

FIG. 12 is an enlarged exploded perspective view of the vane of the dishwasher in accordance with an embodiment of the present disclosure.

As shown in FIG. 12, the vane 400 may include a reflection surface 410 facing the fixed nozzle assembly 320.

The vane 400 may further include a plurality of reflection sections 411 and 412 provided on the reflection surface 410 in the third direction Z and inclined at different angles with respect to a direction H in which washing water is sprayed from the fixed nozzle assembly 320.

The plurality of reflection sections 411 and 412 may include a first reflection section 411 which is struck by washing water sprayed from the fixed nozzle assembly 320, and a second reflection section 412 provided on the upper portion of the first reflection section 411 to guide washing water toward dishes. The movement direction of washing water sprayed from the fixed nozzle assembly 320 may be changed by the second reflection section 412 so as to be directed toward the dishes. An angle θ1 which the first reflection section 411 forms with respect to the direction H in which washing water is sprayed from the fixed nozzle assembly 320 may be larger than an angle θ2 which the second reflection section 412 forms with respect to the direction H in which washing water is sprayed from the fixed nozzle assembly 320. The second reflection section 412 may include a curved surface.

The dishwasher 1 may further include the additional vane 450. The additional vane 450 may be mounted on the vane 400 to reflect washing water sprayed from the additional fixed nozzle 350 toward the dishes.

The vane 400 may further include an additional vane fastening portion 420.

The additional vane 450 may include an additional vane body 451. The additional vane body 451 may be installed on the vane 400 such that space is formed between the additional vane body 451 and the vane 400 to move washing water therethrough. More specifically, the additional vane body 451 may be installed on the vane 400 such that space is formed between the additional vane body 451 and the vane 400 in the third direction Z to move washing water therethrough. That is, the additional vane body 451 may be installed on the vane 400 so as to be spaced a predetermined distance from the reflection surface 410 of the vane 400 in the third direction Z. Also, the additional vane body 451 may be installed on the vane 400 such that space is formed between the additional vane body 451 and the vane 400 in the first direction X to move washing water therethrough. That is, the additional vane body 451 may be installed on the vane 400 so as to be spaced a predetermined distance from the reflection surface 410 of the vane 400 in the first direction X.

The additional vane 450 may further include a fastening rib 425 extending from the additional vane body 451 to be engaged with the additional vane fastening portion 420. The additional vane 450 may be fixedly mounted on the vane 400 by an engagement between the fastening rib 425 and the additional vane fastening portion 420.

The additional vane 450 may further include the reflection surface 410 and the plurality of reflection sections 411 and 412, like the vane 400. The reflection surface 410 and the plurality of reflection sections 411 and 412 of the additional vane 450 may be the same as the reflection surface 410 and the plurality of reflection sections 411 and 412 of the vane 400, and accordingly, detailed descriptions thereof will be omitted.

Figure 13:
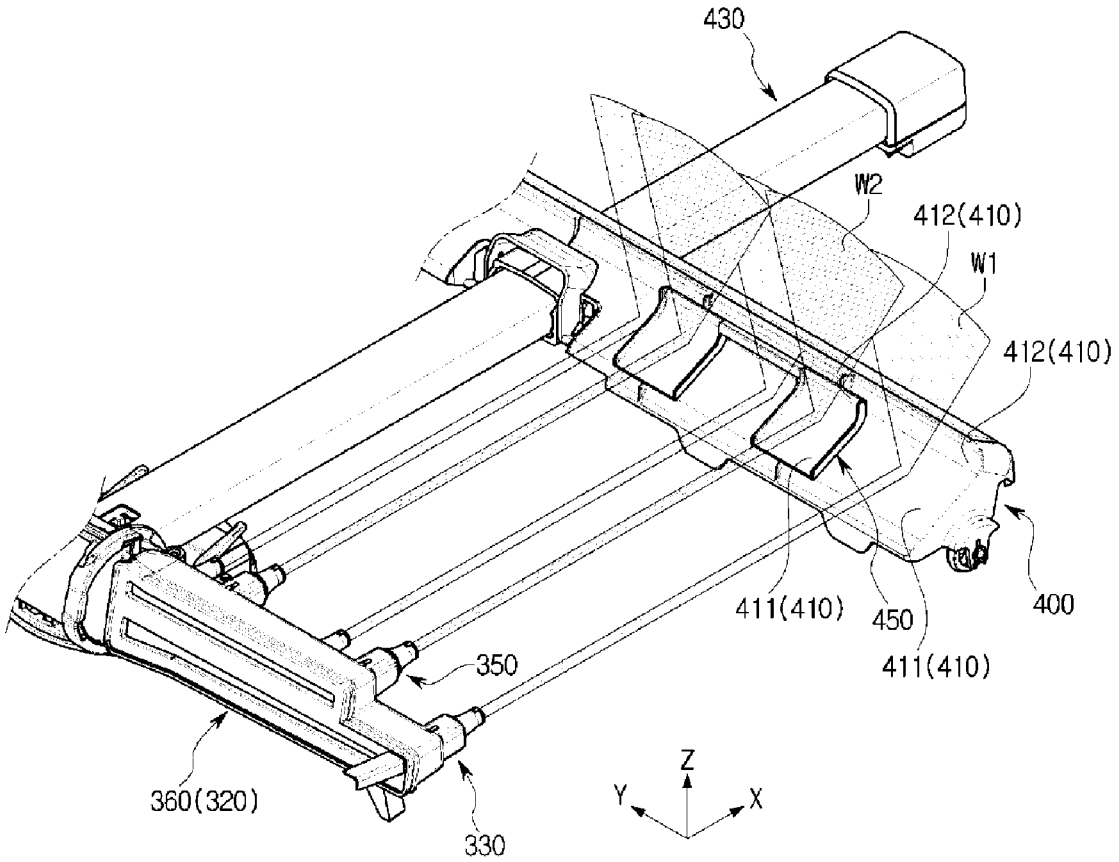
FIG. 13 is a view schematically illustrating an aspect in which the washing water is reflected toward dishes by the vane in the second washing mode of the dishwasher in accordance with an embodiment of the present disclosure.

FIG. 13 is a view schematically illustrating an aspect in which the washing water is reflected toward dishes by the vane in the second washing mode of the dishwasher in accordance with an embodiment of the present disclosure. FIG. 13 is a view illustrating the second washing mode in which the first fixed nozzle 330 and the additional fixed nozzle 350 are involved.

As shown in FIG. 13, washing water sprayed from the first fixed nozzle 330 may collide with the vane 400 to be reflected toward dishes, and washing water sprayed from the additional fixed nozzle 350 may collide with the additional vane 450 to be reflected toward the dishes. More specifically, washing water sprayed from the first fixed nozzle 330 may collide with the first reflection section 411 of the vane 400 and then be reflected toward the dishes through the second reflection section 412. Also, washing water sprayed from the additional fixed nozzle 350 may collide with the first reflection section 411 of the additional vane 450 and then be reflected toward the dishes through the second reflection section 412. Accordingly, by additionally providing the additional vane 450 corresponding to the additional fixed nozzle 350, it is possible to prevent an interference between reflected water W1 that is sprayed from the first fixed nozzle 330 and collides with the vane 400 to be reflected toward the dishes, and reflected water W2 that is sprayed from the additional fixed nozzle 350 and collides with the additional vane 450 to be reflected toward the dishes.

Figure 14:
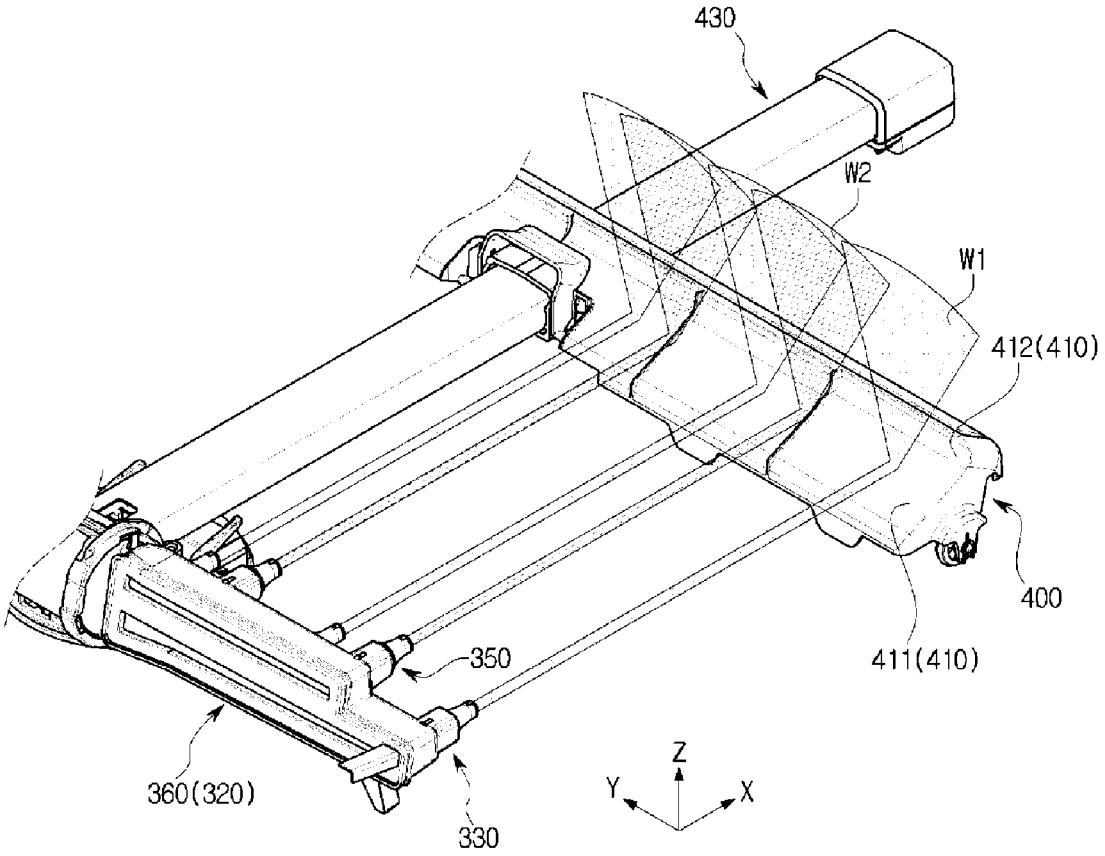
FIG. 14 is a view schematically illustrating an aspect in which washing water is reflected toward the dishes by a vane having a different shape from that of the vane illustrated in FIG. 13, in the second washing mode of the dishwasher in accordance with an embodiment of the present disclosure.

FIG. 14 is a view schematically illustrating an aspect in which washing water is reflected toward the dishes by a vane having a different shape from that of the vane illustrated in FIG. 13, in the second washing mode of the dishwasher in accordance with an embodiment of the present disclosure.

As shown in FIG. 14, the dishwasher 1 may include no additional vane 450.

In this case, both washing water sprayed from the first fixed nozzle 330 and washing water sprayed from the additional fixed nozzle 350 may collide with the vane 400 to be reflected toward dishes. More specifically, both washing water sprayed from the first fixed nozzle 330 and washing water sprayed from the additional fixed nozzle 350 may collide with the first reflection section 411 of the vane 400, and then be reflected toward the dishes via the second reflection section 412. Accordingly, when no additional vane 450 is provided on the vane 400, an interference between the reflected water W1 that is sprayed from the first fixed nozzle 330 and collides with the vane 400 to be reflected toward the dishes, and the reflected water W2 that is sprayed from the additional fixed nozzle 350 and collides with the vane 400 to be reflected toward the dishes may occur.

Figure 15:
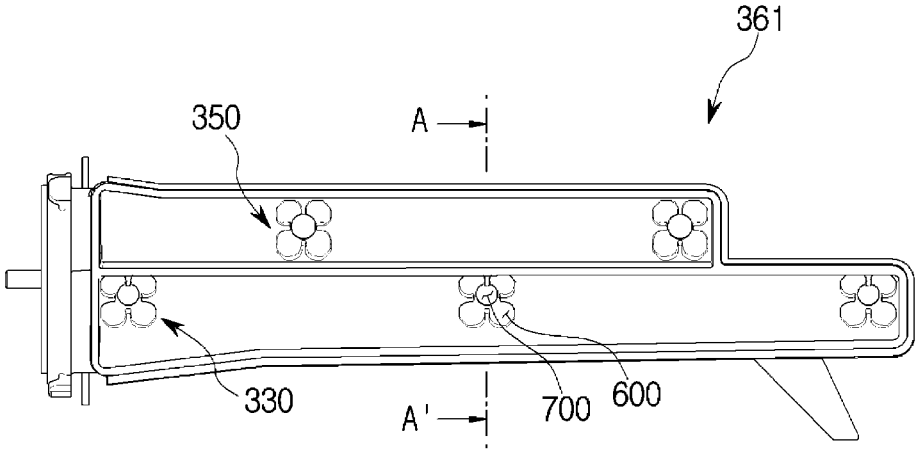
FIG. 15 is a view illustrating the inner surface of a first casing included in the fixed nozzle assembly of the dishwasher in accordance with an embodiment of the present disclosure.
Figure 16:
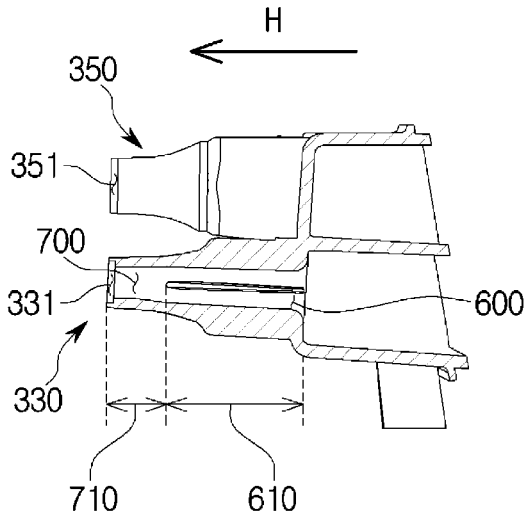
FIG. 16 is a cross-sectional view of the first casing of FIG. 15, cut along a line A-A'.

FIG. 15 is a view illustrating the inner surface of a first casing included in the fixed nozzle assembly of the dishwasher in accordance with an embodiment of the present disclosure, and FIG. 16 is a cross-sectional view of the first casing of FIG. 15, cut along a line A-A'.

As shown in FIGS. 15 and 16, the first fixed nozzle 330 and the additional fixed nozzle 350 may include a plurality of first spray flow paths 600 and a single second spray flow path 700, respectively.

The plurality of first spray flow paths 600 may be positioned on the upstream side in the direction H in which washing water is sprayed from the fixed nozzle assembly 320. The single second spray flow path 700 may be positioned in the downstream region in the direction H in which washing water is sprayed from the fixed nozzle assembly 320. The spray holes 331 and 351 may be provided at an end of the single second spray flow path 700.

As shown in FIG. 15, the plurality of first spray flow paths 600 may be arranged in the shape of a four-leaf clover.

The second fixed nozzle 340 may also include the plurality of first spray flow paths 600 and the single second spray flow path 700, like the first fixed nozzle 330 and the additional fixed nozzle 350 may.

In other words, each of the first fixed nozzle 330, the second fixed nozzle 340, and the additional fixing nozzle 350 may include a first flow path section 610 which is positioned on the upstream side in the spraying direction H of washing water from the fixed nozzle assembly 320 and in which the plurality of first spray flow paths 600 are formed, and a second flow path section 710 which is positioned in the downstream side in the spraying direction H of washing water from the fixed nozzle assembly 320 and in which the single second spray flow path 700 at which washing water passed through the plurality of first spray flow paths 600 meets is formed.

When washing water entered the first fixed nozzle 330, the second fixed nozzle 340, or the additional fixed nozzle 350 passes through each of the plurality of the first spray flow paths 600 and the single second spray flow path 700, the straightness of the washing water flowing into the first fixed nozzle 330, the second fixed nozzle 340 or the additional fixed nozzle 350 can be improved. Accordingly, washing water sprayed through the spray holes 331, 341 and 351 may stably arrive at specific positions of the vane 400 at which high washing efficiency can be expected. In addition, the water pressure of washing water sprayed from the first fixed nozzle 330, the second fixed nozzle 340, or the additional fixed nozzle 350 can be maintained at a predetermined level or higher, thereby improving the washing power of the dishwasher.

Figure 17:
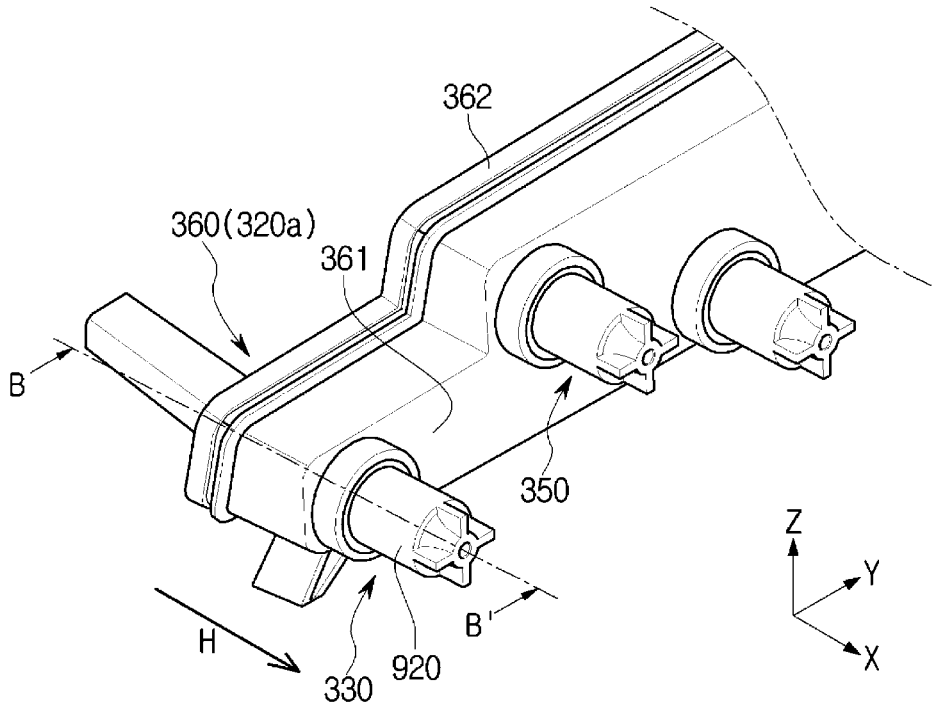
FIG. 17 is a view illustrating a fixed nozzle assembly of a dishwasher in accordance with an embodiment of the present disclosure.
Figure 18:
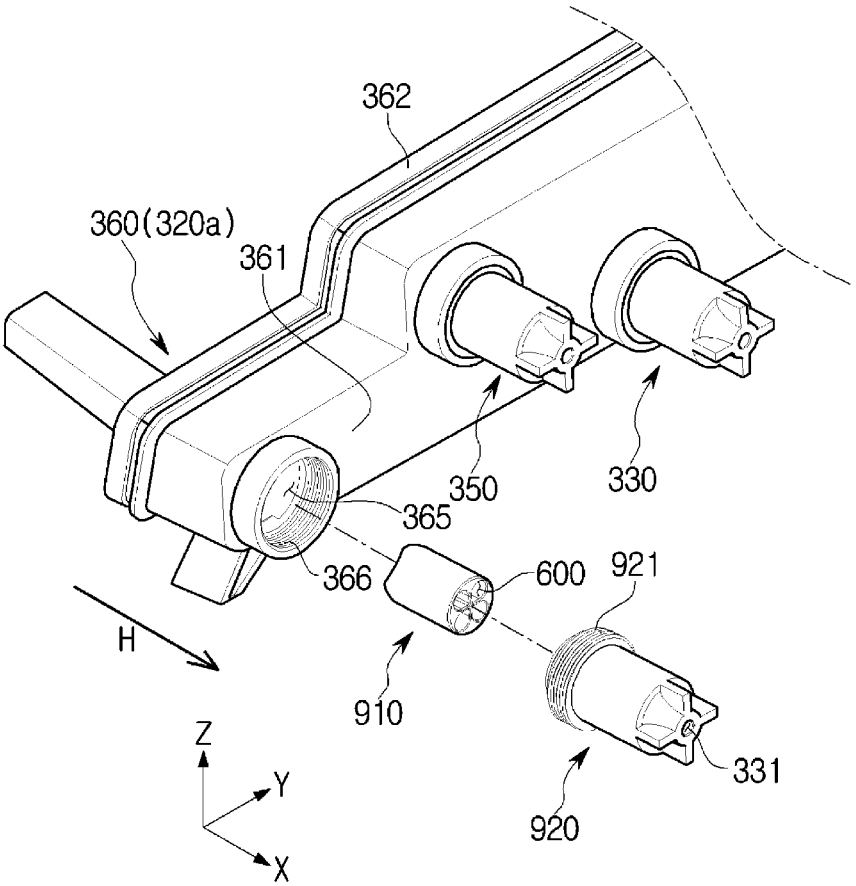
FIG. 18 is an exploded perspective view illustrating a fixed nozzle of the fixed nozzle assembly of FIG. 17.
Figure 19:
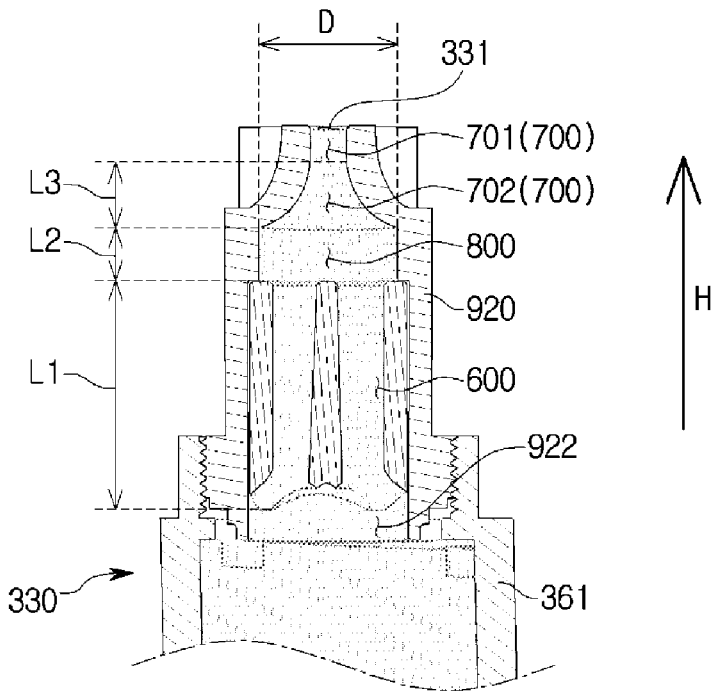
FIG. 19 is a cross-sectional view of the fixed nozzle of the fixed nozzle assembly of FIG. 17, cut along a line B-B'.

FIG. 17 is a view illustrating a fixed nozzle assembly of a dishwasher in accordance with an embodiment of the present disclosure, and FIG. 18 is an exploded perspective view illustrating a fixed nozzle of the fixed nozzle assembly of FIG. 17. FIG. 19 is a cross-sectional view of the fixed nozzle of the fixed nozzle assembly of FIG. 17, cut along a line B-B'. Hereinafter, the same descriptions as those described above with reference to FIGS. 1 to 16 may be omitted. Herein, the fixed nozzle may include a first fixed nozzle 330, a second fixed nozzle 340, and an additional fixed nozzle 350. Hereinafter, for convenience of description, the first fixed nozzle 330 will be mainly described.

As shown in FIGS. 17 to 19, the first fixed nozzle 330 may include the plurality of first spray flow paths 600 and the single second spray flow path 700. The plurality of first spray flow paths 600 may be positioned on the upstream side in the direction H in which washing water is sprayed from a fixed nozzle assembly 320*a*. The single second spray flow path 700 may be positioned on the downstream side in the direction H in which washing water is sprayed from the fixed nozzle assembly 320*a*.

The first fixed nozzle 330 may further include a washing water accommodating portion 800. The washing water accommodating portion 800 may be positioned between the plurality of first spray flow paths 600 and the single second spray flow path 700 so as to temporarily accommodate washing water passed through the plurality of first spray flow paths 600. The washing water accommodating portion 800 may have a width that is wider than those of the plurality of first spray flow paths 600 and the single second spray flow path 700.

The single second spray flow path 700 may include a straight section 701 and a curved section 702. At one end of the straight section 701, the spray hole 331 may be provided. The curved section 702 may connect the other end of the straight section 701 to the washing water accommodating section 800. The width of the curved section 702 may be wider at the portion located closer to the washing water accommodating section 800, and narrower at the portion located closer to the straight section 701.

When the length of the plurality of first spray flow paths 600 in the direction H in which washing water is sprayed from the fixed nozzle assembly 320*a* is defined as L1, the length of the washing water accommodating portion 800 in the direction H in which washing water is sprayed from the fixed nozzle assembly 320*a* is defined as L2, and the length of the curved section 702 in the direction H in which washing water is sprayed from the fixed nozzle assembly 320*a* is defined as L3, the following relationship may be established between the sum L of L1, L2 and L3, and the width D of the washing water accommodating portion 800.

$$L/D>2 \qquad \text{[relationship 1]}$$

Further, the width D of the washing water accommodating portion 800 may be larger than 10 mm.

The first fixed nozzle 330 may further include a guide member 910 and a nozzle cap 920.

The plurality of first spray flow paths 600 may be formed inside the guide member 910.

A guide member accommodating portion 922 in which the guide member 910 is accommodated, the washing water accommodating portion 800, and the single second spray flow path 700 may be formed in the nozzle cap 920. The spray hole 331 may be formed at one end of the nozzle cap 920, and a first screw thread 921 may be formed at the other end of the nozzle cap 920. The first screw thread 921 may be formed on the outer circumferential surface of the nozzle cap 920.

The fixed nozzle assembly 320*a* may further include the casings 361 and 362 having a flow path formed therein and a fixed nozzle coupling portion 365. More specifically, the fixed nozzle coupling portion 365 may be formed in the first casing 361. The nozzle cap 920 may be coupled to the fixed nozzle coupling portion 365. In the fixed nozzle coupling portion 365, a second screw thread 366 may be formed to be coupled with the first screw thread 921. The second screw thread 366 may be formed on the inner circumferential surface of the fixed nozzle coupling portion 365.

As shown in FIG. 18, the plurality of first spray flow paths 600 may be arranged in the shape of a four-leaf clover.

Figure 20:
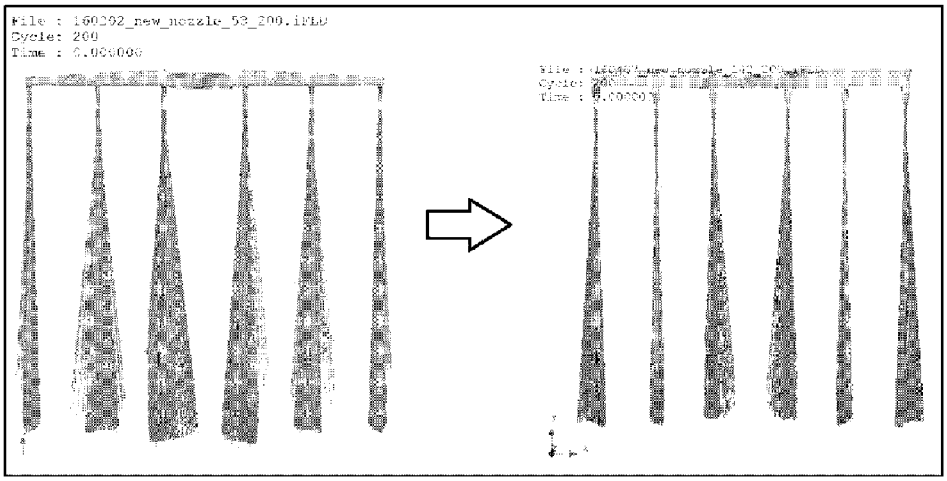
FIG. 20 is a view showing a result that the straightness of washing water sprayed from the fixed nozzle is improved when the fixed nozzle assembly of FIG. 17 is applied to the dishwasher in accordance with an embodiment of the present disclosure.

FIG. 20 is a view showing a result that the straightness of washing water sprayed from the fixed nozzle is improved when the fixed nozzle assembly of FIG. 17 is applied to the dishwasher in accordance with an embodiment of the present disclosure. FIG. 20 shows the standard deviation of "movement in the Y-axis direction" and "movement in the Z-axis direction" except for "movement in the X-axis direction", when a movement of the washing water sprayed from the fixed nozzle toward the vane 400 or the additional vane 450 is defined as "movement in the X-axis direction". The left part of FIG. 20 shows a result obtained when a fixed nozzle in which the sum L of the length L1 of the plurality of first spray flow paths 600, the length L2 of the washing water accommodating portion 800, and the length L3 of the curved section 702 and the width D of the washing water accommodating portion 800 do not satisfy the relationship 1, and the width D of the washing water accommodating portion 800 is smaller than 10 mm is applied. The right part of FIG. 20 shows a result obtained when a fixed nozzle in which the sum L of the length L1 of the plurality of first spray flow paths 600, the length L2 of the washing water accommodating portion 800 and the length L3 of the curved section 702 and the width D of the washing water accommodating portion 800 satisfy the relationship 1, and the width D of the washing water accommodating portion 800 is larger than 10 mm is applied.

As shown in FIG. 20, when a fixed nozzle is designed so that the sum L of the length L1 of the plurality of first spray flow paths 600, the length L2 of the washing water accommodating portion 800 and the length L3 of the curved section 702, and the width D of the washing water accommodating portion 800 satisfy the relationship 1, and the width D of the washing water accommodating portion 800 is larger than 10 mm, the straightness of washing water sprayed from the fixed nozzle can be improved. The result of an experiment shows that the straightness of washing water sprayed from the fixed nozzle was improved by approximately 12%.

Figure 21:
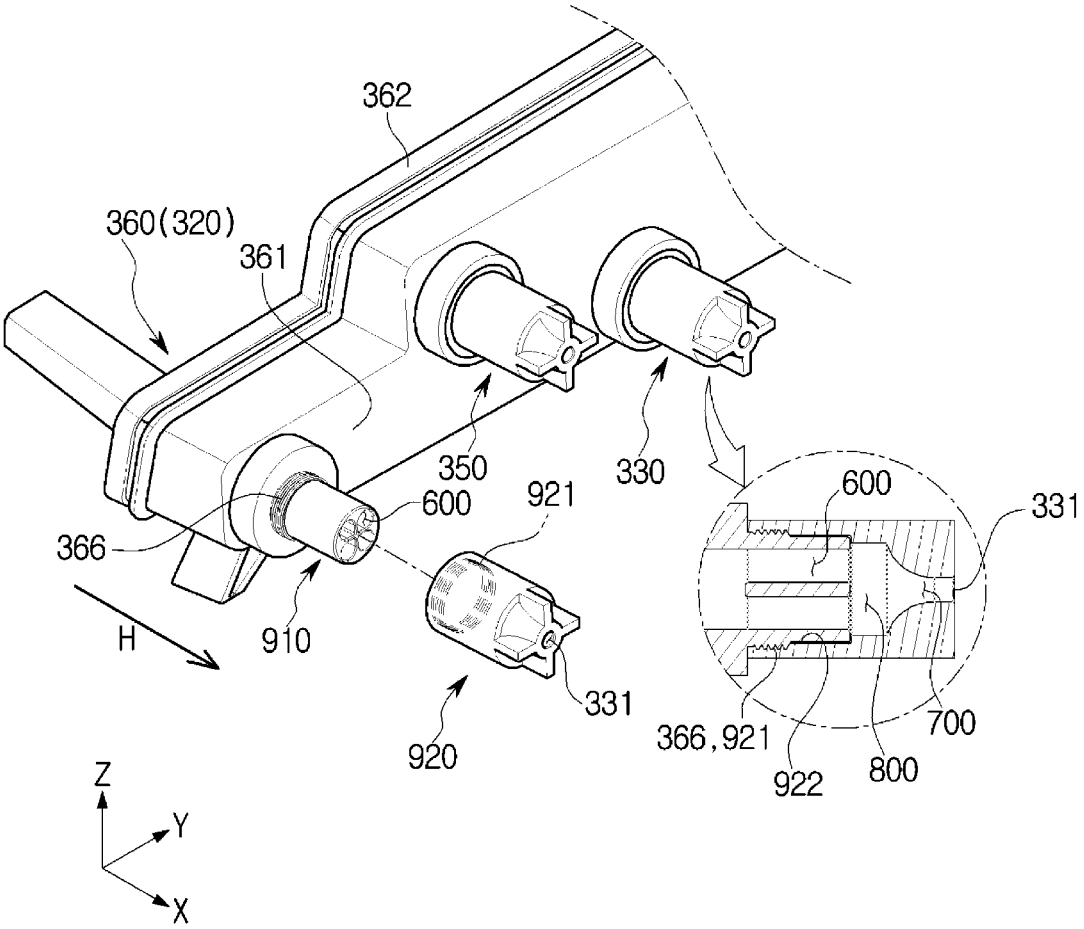
FIG. 21 is an exploded perspective view illustrating a fixed nozzle assembly of a dishwasher in accordance with an embodiment of the present disclosure.

FIG. 21 is an exploded perspective view illustrating a fixed nozzle assembly of a dishwasher in accordance with an embodiment of the present disclosure. Hereinafter, the same descriptions as those described above with reference to FIGS. 17 to 19 will be omitted. Here, a fixed nozzle may include the first fixed nozzle 330, the second fixed nozzle 340, and the additional fixed nozzle 350. Here, for convenience of explanation, the first fixed nozzle 330 will be mainly described.

As shown in FIG. 21, the first fixed nozzle 330 may further include the guide member 910 and the nozzle cap 920.

The guide member 910 may be integrated into the casings 361 and 362. In other words, the guide member 910 may extend from the casings 361 and 362 toward the vane 400. More specifically, the guide member 910 may extend from the first casing 361 toward the vane 400. The plurality of spray flow paths 600 may be formed in the guide member 910. The second screw thread 366 may be formed on the outer circumferential surface of the guide member 910.

The guide member accommodating portion 922 in which the guide member 910 is accommodated, the washing water accommodating portion 800 and the single second spray flow path 700 may be formed in the nozzle cap 920. The spray hole 331 may be formed at one end of the nozzle cap 920. The first screw thread 921 may be formed at the other end of the nozzle cap 920. The first screw thread 921 may be formed on the inner circumferential surface of the nozzle cap 920. The nozzle cap 920 may be engaged with the guide member 910. At this time, the first screw thread 921 may be engaged with the second screw thread 366.

Figure 22:
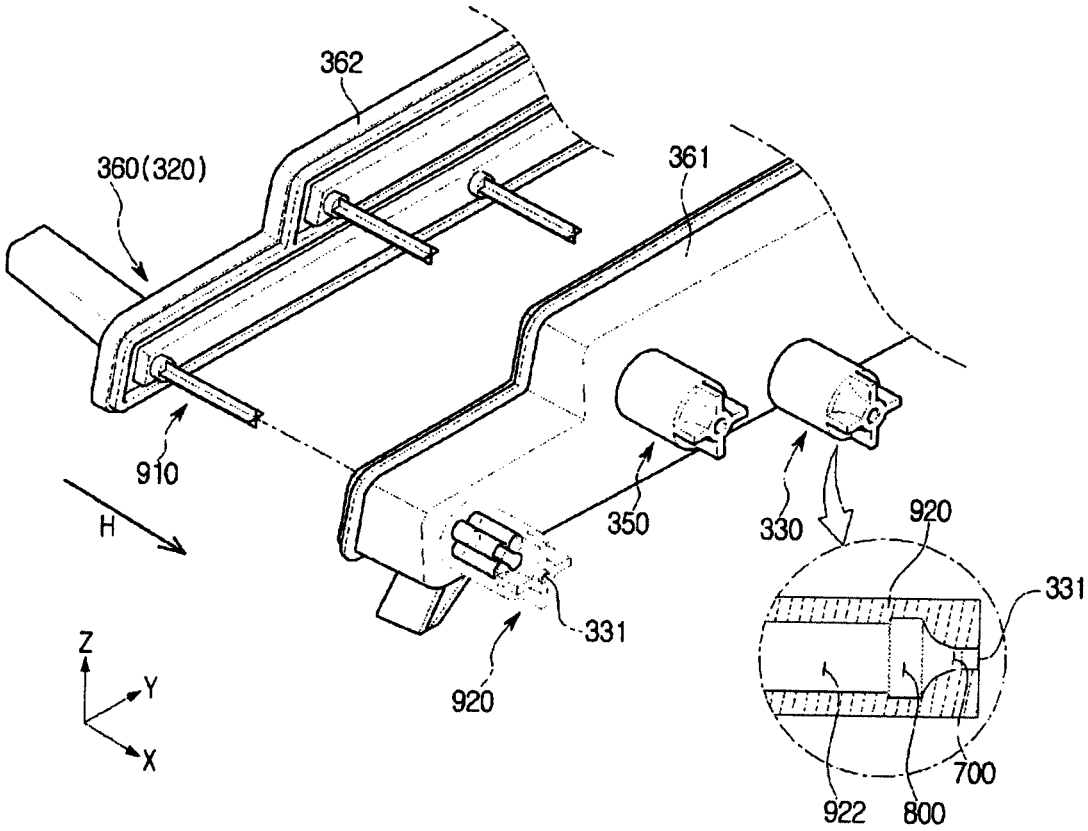
FIG. 22 is an exploded perspective view illustrating a fixed nozzle assembly of a dishwasher in accordance with an embodiment of the present disclosure.

FIG. 22 is an exploded perspective view illustrating a fixed nozzle assembly of a dishwasher in accordance with an embodiment of the present disclosure. Hereinafter, the same descriptions as those described above with reference to FIGS. 17 to 19 will be omitted. Herein, a fixed nozzle may include the first fixed nozzle 330, the second fixed nozzle 340 and the additional fixed nozzle 350. Here, for convenience of description, the first fixed nozzle 330 will be mainly described.

As shown in FIG. 22, the first fixed nozzle 330 may further include the guide member 910 and the nozzle cap 920.

The guide member 910 may extend from the second casing 362 toward the vane 400.

The nozzle cap 920 may extend from the first casing 361 toward the vane 400. The guide member accommodating portion 922 may be provided in the nozzle cap 920, and may be coupled with the guide member 910 to form the plurality of first spray flow paths. The washing water accommodating portion 800 and the single second spray flow path 700 may be further provided in the nozzle cap 920. The spray hole 331 may be formed at one end of the nozzle cap 920.

Figure 23:
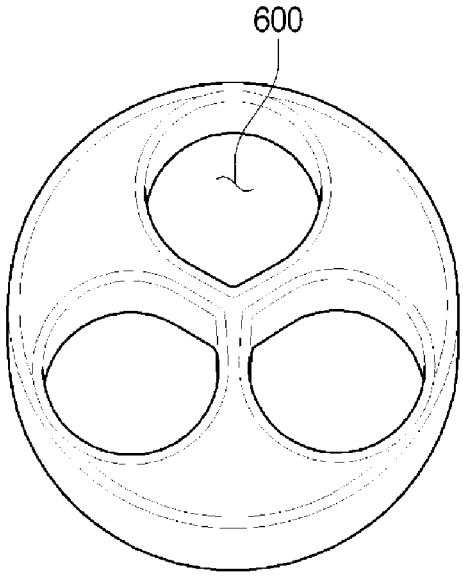
FIGS. 23, 24, and 25 are views illustrating various arrangement relationships of a plurality of first spray flow paths in a fixed nozzle of a dishwasher in accordance with an embodiment of the present disclosure.
Figure 24:
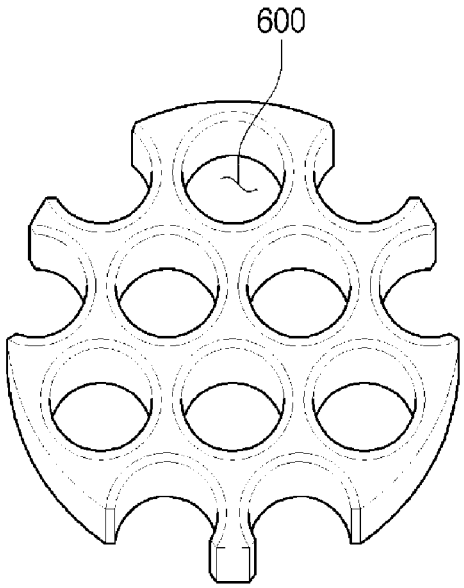
Figure 25:
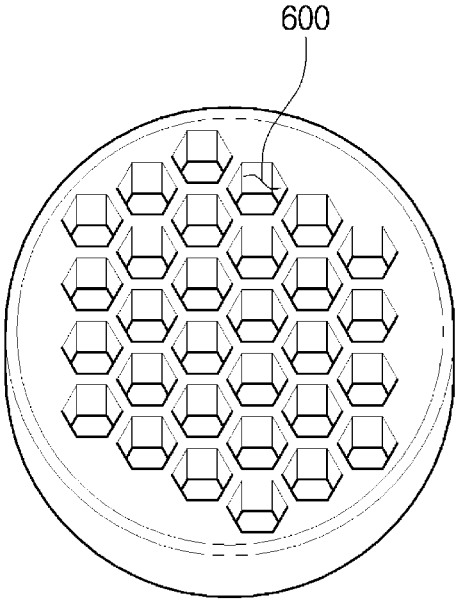

FIGS. 23 to 25 are views illustrating various arrangement relationships of a plurality of first spray flow paths in a fixed nozzle of a dishwasher in accordance with an embodiment of the present disclosure. FIGS. 23 to 25 illustrate various arrangement relationship of the plurality of first spray flow paths 600 formed in the guide member 910. Hereinafter, the same descriptions as those described above with reference to FIGS. 17 to 19 will be omitted. Here, a fixed nozzle may include the first fixed nozzle 330, the second fixed nozzle 340, and the additional fixed nozzle 350.

As shown in FIG. 23, the plurality of first spray flow paths 600 may be arranged in the shape of a three-leaf clover. The cross section of each first spray flow path 600 may be in the shape of a droplet.

As shown in FIG. 24, the cross section of each first spray flow path 600 may be in a shape of a circle.

As shown in FIG. 25, the plurality of first spray flow paths 600 may be arranged in the shape of a honeycomb. The cross section of each first spray flow path 600 may be in the shape of a hexagon.

The plurality of first spray flow paths 600 may be arranged in the shape of a four-leaf clover or a three-leaf clover.

The arrangement of the plurality of first spray flow paths 600 and the cross-sectional shape of each first spray flow path 600 may not be limited to the above examples.

Figure 26:
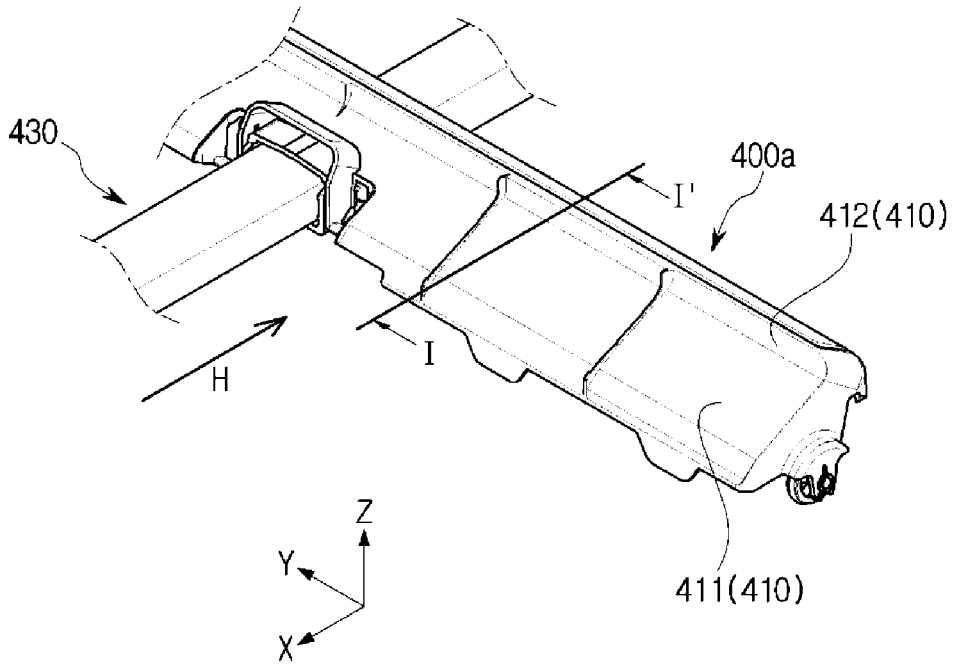
FIG. 26 is a perspective view illustrating a vane of a dishwasher in accordance with an embodiment of the present disclosure.
Figure 27:
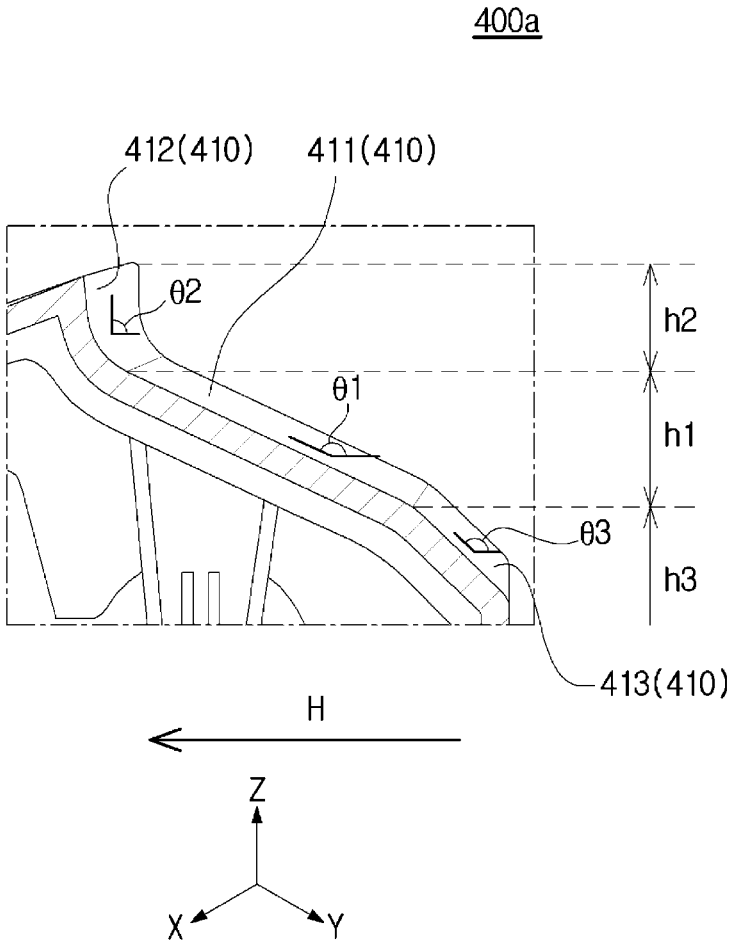
FIG. 27 is a cross-sectional view of the vane of FIG. 26, cut along a line I-I'.

FIG. 26 is a perspective view illustrating a vane of a dishwasher in accordance with an embodiment of the present disclosure, and FIG. 27 is a cross-sectional view of the vane of FIG. 26, cut along a line I-I'. Hereinafter, the same descriptions as those described above with reference to FIGS. 1 to 16 will be omitted.

As shown in FIGS. 26 and 27, a vane 400*a* may include the reflection surface 410 facing the fixed nozzle assembly 320.

The vane 400*a* may further include a plurality of reflection sections 411, 412 and 413 provided on the reflection surface 410 in the third direction Z to be inclined at different angles with respect to the direction H in which washing water is sprayed from the fixed nozzle assembly 320.

The plurality of reflection sections 411, 412 and 413 may include a first reflection section 411 which is struck by washing water sprayed from the fixed nozzle assembly 320, a second reflection section 412 provided on the upper part of the first reflection section 411 to guide washing water toward dishes, and a third reflection section 413 provided on the lower part of the first reflection section 411.

An angle θ1 which the first reflection section 411 forms with respect to the direction H in which washing water is sprayed from the fixed nozzle assembly 320 may be larger than an angle θ2 which the second reflection section 412 forms with respect to the direction H in which washing water is sprayed from the fixed nozzle assembly 320, and an angle θ3 which the third reflection section 413 forms with respect to the direction H in which washing water is sprayed from the fixed nozzle assembly 320.

Also, the angle θ2 which the second reflection section 412 forms with respect to the direction H in which washing water is sprayed from the fixed nozzle assembly 320 may be smaller than the angle θ1 which the first reflection section 411 forms with respect to the direction H in which washing water is sprayed from the fixed nozzle assembly 320, and the angle θ3 which the third reflection section 413 forms with respect to the direction H in which washing water is sprayed from the fixed nozzle assembly 320.

The following relationship may be established between θ1, θ2 and θ3. Herein, θ1 is defined as an angle which the first reflection section 411 forms with respect to the direction H in which washing water is sprayed from the fixed nozzle assembly 320, θ2 is defined as an angle which the second reflection section 412 forms with respect to the direction H in which washing water is sprayed from the fixed nozzle assembly 320, and θ3 is defined as an angle which the third reflection section 413 forms with respect to the direction H in which washing water is sprayed from the fixed nozzle assembly 320.

$$\theta 1>\theta 3>\theta 2 \quad \text{[relationship 2]}$$

When the height of the first reflection section 411 in the third direction Z is defined as h1, the height of the second reflection section 412 in the third direction Z is defined as h2, and the height of the third reflection section 413 in the third direction Z is defined as h3, the following relationship may be established between h1, h2 and h3.

$$h1>h3>h2 \quad \text{[relationship 3]}$$

When the vane 400*a* is designed to satisfy the relationship 2 and relationship 3, the intensity of reflected water reflected toward the dishes after colliding with the vane 400*a* can increase by approximately 47% or more compared to the typical technique.

Figure 28:
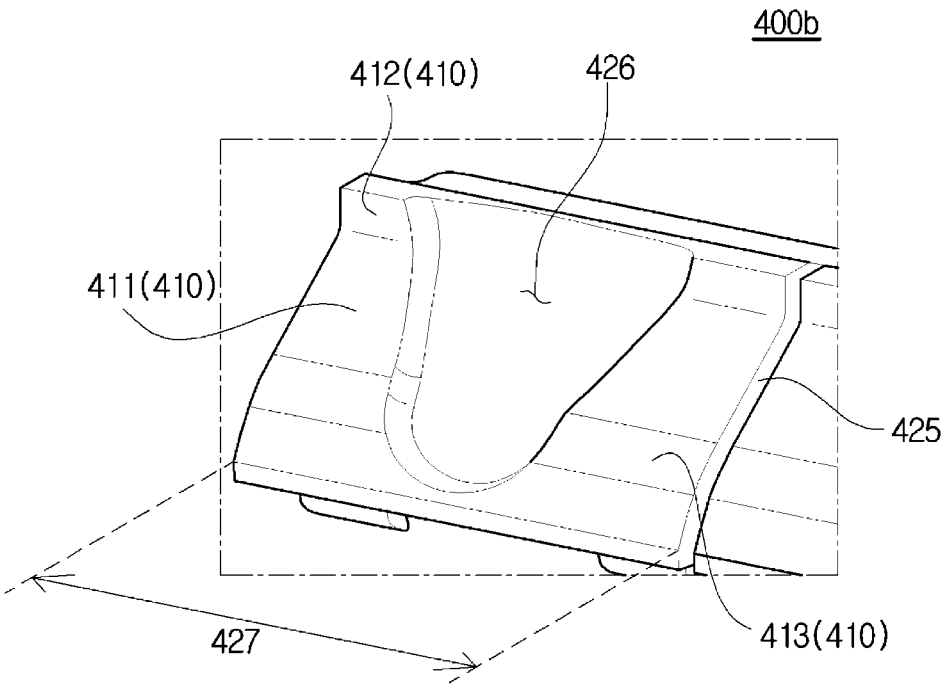
FIG. 28 is a view illustrating a vane having a different shape from that of the vane illustrated in FIG. 26, in a dishwasher in accordance with an embodiment of the present disclosure.

FIG. 28 is a view illustrating a vane having a different shape from that of the vane illustrated in FIG. 26, in a dishwasher in accordance with an embodiment of the present disclosure. Hereinafter, the same descriptions as those described above with reference to FIGS. 26 and 27 will be omitted.

As shown in FIG. 28, a vane 400*b* may further include the rib 425. When the first fixed nozzle 330 and the second fixed nozzle 340 include a plurality of first fixed nozzles and a plurality of second fixed nozzles, respectively, the rib 435 may protrude from the reflection surface 410 to partition a plurality of struck sections 427 corresponding to the plurality of the first fixed nozzles and the plurality of the second fixed nozzles, respectively.

The plurality of struck sections 427 may be provided with a recessed portion 426.

When the reflection surface 410 of the vane 400*b* is partitioned into the plurality of struck sections 427 by using the rib 425 and the recessed portion 426 is formed in the plurality of struck sections 427, the intensity of reflected water reflected toward the dishes after colliding with the vane 400*b* may increase by approximately 73% or more compared to the typical technique.

Figure 29:
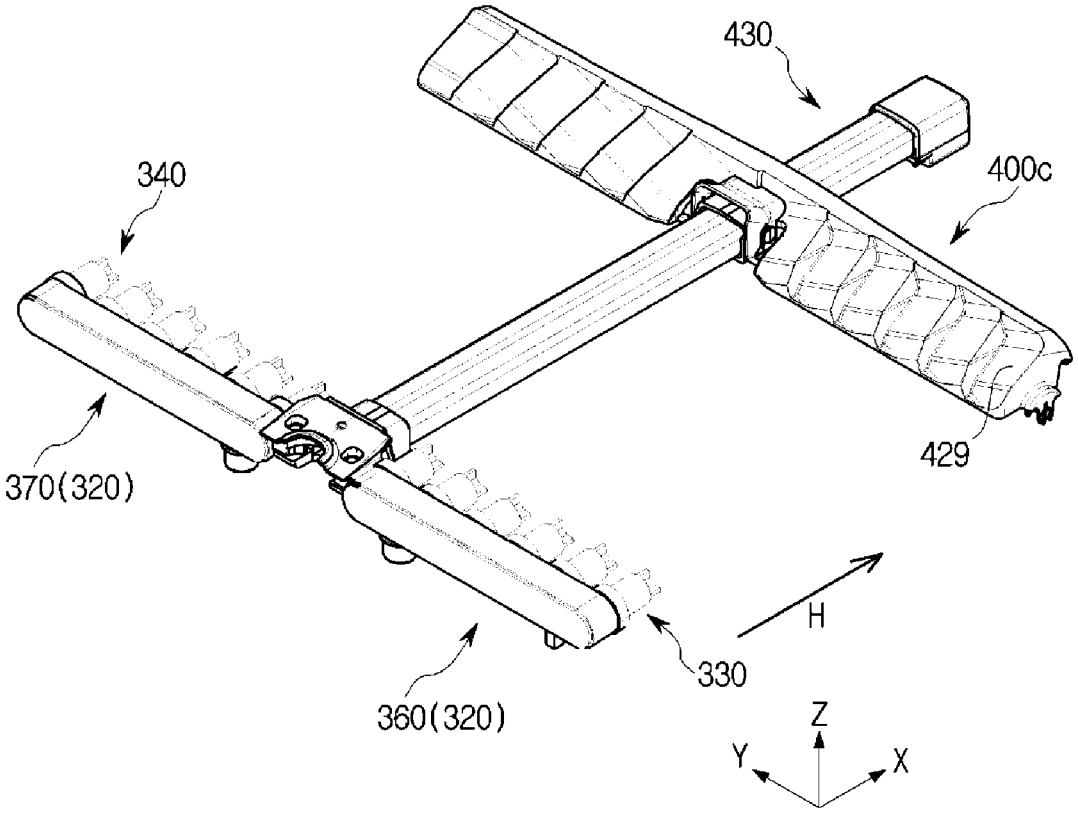
FIG. 29 is a view illustrating a fixed nozzle assembly and a vane of a dishwasher in accordance with an embodiment of the present disclosure.
Figure 30:
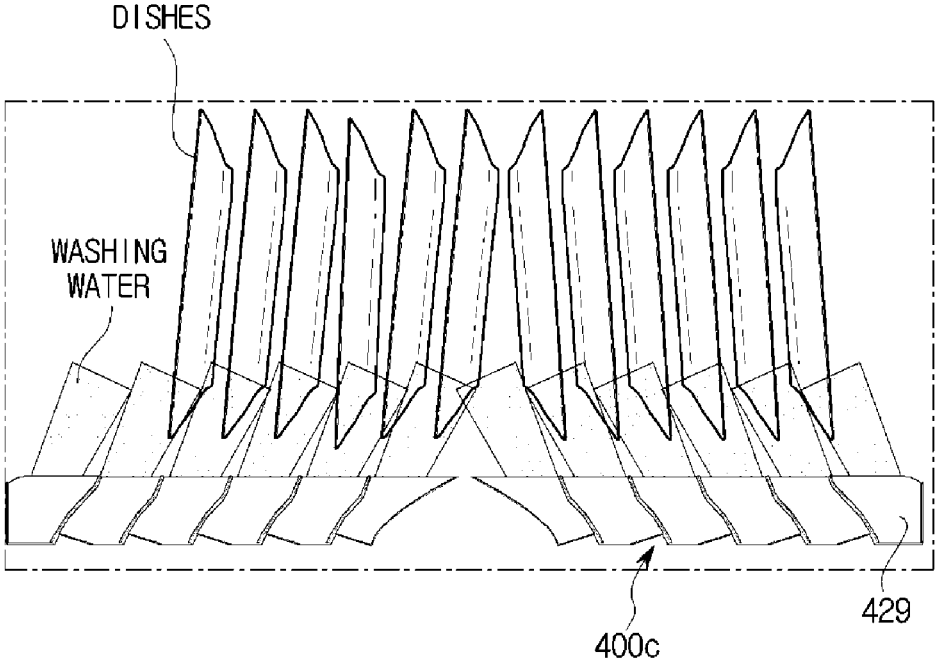
FIG. 30 is a view schematically illustrating an aspect in which washing water is reflected toward the dishes by the vane illustrated in FIG. 29.

FIG. 29 is a view illustrating a fixed nozzle assembly and a vane of a dishwasher in accordance with an embodiment of the present disclosure, and FIG. 30 is a view schematically illustrating an aspect in which washing water is reflected toward the dishes by the vane illustrated in FIG. 29.

As shown in FIGS. 29 and 30, the fixed nozzle assembly 320 may include the plurality of first fixed nozzles 330 aligned in the second direction Y.

A vane 400*c* may be movably installed in the washing tub 30 along the first direction X so as to reflect washing water sprayed from the fixed nozzle assembly 320 toward the dishes.

The vane 400*c* may include the reflection surface 410 facing the fixed nozzle assembly 320.

The vane 400*c* may include a plurality of reflection sections 429 provided on the reflection surface 410 along the second direction Y that is at right angles to the first direction X so as to be inclined at different angles with respect to the direction H in which washing water is sprayed from the fixed nozzle assembly 320.

In other words, the vane 400*c* may include the plurality of reflection sections 429 provided on the reflection surface 410 along the second direction Y so as to be inclined at different angles with respect to the direction H in which washing water is sprayed from the fixed nozzle assembly 320 so that washing water can enter between the dishes.

The plurality of reflection sections 429 formed in the first fixed nozzle unit 360 may be symmetrical to the plurality of reflection sections 429 formed in the second fixed nozzle unit 370.

As shown in FIG. 30, when the plurality of reflection sections 429 are formed on the reflection surface 410 along the second direction Y so as to be formed with different angles with respect to the direction H in which washing water is sprayed from the fixed nozzle assembly 320, washing water can be sprayed between the dishes, thereby washing the dishes more cleanly.

The plurality of reflection sections 411, 412 and 413, which are described above with reference to FIGS. 26 and 27, may be formed in the plurality of reflection sections 429 shown in FIGS. 29 and 30.

The plurality of reflection sections 429, which are described above with reference to FIGS. 29 and 30, may be applied to the vane 400 to the additional vane 450 described above with reference to FIGS. 1 to 16.

When the fixed nozzle assembly is designed to further include the additional fixed nozzle, it is possible to secure a large amount of flow and water pressure exceeding a specific level, resulting in high washing efficiency upon separate washing.

By designing the fixed nozzle so that the sum L of the length L1 of the plurality of the first spray flow paths, the length L2 of the washing water accommodating portion and the length L3 of the curved section, and the width D of the washing water accommodating portion satisfy the relationship 1, and the width D of the washing water accommodating portion is larger than 10 mm, the straightness of washing water sprayed from the fixed nozzle can be improved.

By designing the vane to satisfy the relationship 2 and the relationship 3, it is possible to increase the intensity of reflected water reflected toward dishes after colliding with the vane.

When the plurality of reflection sections are formed on the reflection surface along the second direction so as to be formed with different angles with respect to the direction in which washing water is sprayed from the fixed nozzle assembly, washing water can enter between dishes, thereby washing the dishes more cleanly.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A dishwasher comprising:

a main body;

a washing tub provided inside the main body;

a fixed nozzle assembly fixed to one side of the washing tub, and configured to spray washing water in a first direction; and a vane installed inside the washing tub, extending lengthwise in a second direction, and configured to be movable along the first direction and to reflect the washing water sprayed from the fixed nozzle assembly, wherein the fixed nozzle assembly comprises:

a first fixed nozzle facing the vane in the first direction, and arranged along the second direction;

a second fixed nozzle arranged along the second direction so that the first fixed nozzle and the second fixed nozzle correspond to the lengthwise extension of the vane, and facing the vane in the first direction; and a third fixed nozzle positioned above the first fixed nozzle and the second fixed nozzle in a third direction perpendicular to the second direction, and facing the vane in the first direction, and wherein the vane comprises:

a reflection surface facing the fixed nozzle assembly; and a plurality of reflection sections provided on the reflection surface along the third direction, and inclined at different angles with respect to the first direction in which the washing water is sprayed from the fixed nozzle assembly.

2. The dishwasher of claim 1, wherein the plurality of reflection sections comprise:

a first reflection section; and a second reflection section provided above the first reflection section in the third direction, and configured to guide the washing water sprayed from the fixed nozzle assembly to the third direction; and a third reflection section provided below the first reflection section in the third direction.

3. The dishwasher of claim 2, wherein an angle θ1, which the first reflection section forms with respect to the first direction in which the washing water is sprayed from the fixed nozzle assembly, is larger than an angle θ2, which the second reflection section forms with respect to the first direction in which the washing water is sprayed from the fixed nozzle assembly, and an angle θ3, which the third reflection section forms with respect to the first direction in which the washing water is sprayed from the fixed nozzle assembly.

4. The dishwasher of claim 2, wherein an angle θ2, which the second reflection section forms with respect to the first direction in which the washing water is sprayed from the fixed nozzle assembly, is smaller than an angle θ1, which the first reflection section forms with respect to the first direction in which the washing water is sprayed from the fixed nozzle assembly, and an angle θ3, which the third reflection section forms with respect to the first direction in which the washing water is sprayed from the fixed nozzle assembly.

5. A dishwasher comprising:

a main body;

a washing tub provided inside the main body;

a fixed nozzle assembly fixed to one side of the washing tub, and configured to spray washing water in a first direction; and a vane installed inside the washing tub, extending lengthwise in a second direction, and configured to be movable along the first direction and to reflect the washing water sprayed from the fixed nozzle assembly, wherein the fixed nozzle assembly comprises:

a first fixed nozzle facing the vane in the first direction, and arranged along the second direction;

a second fixed nozzle arranged along the second direction so that the first fixed nozzle and the second fixed nozzle correspond to the lengthwise extension of the vane, and facing the vane in the first direction; and a third fixed nozzle positioned above the first fixed nozzle and the second fixed nozzle in a third direction perpendicular to the second direction, and facing the vane in the first direction.

6. The dishwasher of claim 5, wherein the second fixed nozzle is controllable independently from the first fixed nozzle and the third fixed nozzle.

7. The dishwasher of claim 5, further comprising an additional vane installed on the vane, and configured to reflect the washing water sprayed from the third fixed nozzle from the first direction to the third direction.

8. The dishwasher of claim 7, wherein the vane comprises an additional vane fastening portion, and the additional vane comprises:

an additional vane body installed on the vane such that space is formed between the additional vane body and the vane to move washing water therethrough; and a fastening rib extending from the additional vane body and configured to be coupled to the additional vane fastening portion.

9. The dishwasher of claim 5, wherein the vane comprises:

a reflection surface facing the fixed nozzle assembly; and a plurality of reflection sections provided on the reflection surface along the third direction, and inclined at different angles with respect to the first direction in which the washing water is sprayed from the fixed nozzle assembly, such that the washing water sprayed from the fixed nozzle assembly is reflected from the first direction to the third direction.

10. The dishwasher of claim 9, wherein the plurality of reflection sections comprise:

a first reflection section; and a second reflection section provided above the first reflection section in the third direction, and configured to guide the washing water sprayed from the fixed nozzle assembly to the third direction; and a third reflection section provided below the first reflection section in the third direction.

11. The dishwasher of claim 10, wherein an angle θ1, which the first reflection section forms with respect to the first direction in which the washing water is sprayed from the fixed nozzle assembly, is larger than an angle θ2, which the second reflection section forms with respect to the first direction in which the washing water is sprayed from the fixed nozzle assembly, and an angle θ3, which the third reflection section forms with respect to the first direction in which the washing water is sprayed from the fixed nozzle assembly.

12. The dishwasher of claim 10, wherein an angle θ2, which the second reflection section forms with respect to the first direction in which the washing water is sprayed from the fixed nozzle assembly, is smaller than an angle θ1, which the first reflection section forms with respect to the first direction in which the washing water is sprayed from the fixed nozzle assembly, and an angle θ3, which the third reflection section forms with respect to the first direction in which the washing water is sprayed from the fixed nozzle assembly.

13. The dishwasher of claim 9, wherein the first fixed nozzle and the second fixed nozzle include a plurality of first fixed nozzles and a plurality of second fixed nozzles, respectively, and the vane further comprises a rib protruding from the reflection surface to partition the reflection surface into a plurality of sections corresponding to the plurality of first fixed nozzles and the plurality of second fixed nozzles, respectively.

14. The dishwasher of claim 13, wherein a recessed portion is formed in the plurality of sections.

15. The dishwasher of claim 5, wherein each of the first fixed nozzle, the second fixed nozzle, and the third fixed nozzle comprises:

a first flow path section positioned on an upstream side in the first direction in which the washing water is sprayed from the fixed nozzle assembly, wherein a plurality of first spray flow paths are formed in the first flow path section; and a second flow path section positioned on a downstream side in the first direction in which the washing water is sprayed from the fixed nozzle assembly, wherein a single second spray flow path at which washing water passed through the plurality of first spray flow paths meets is formed in the second flow path section.

16. A dishwasher comprising:

a main body;

a washing tub provided inside the main body;

a fixed nozzle assembly fixed to one side of the washing tub, and configured to spray washing water in a first direction; and a vane movably installed inside the washing tub to be moved along the first direction, extending lengthwise in a second direction, and configured to reflect the washing water sprayed from the fixed nozzle assembly from the first direction to a third direction, wherein the vane comprises:

a reflection surface facing the fixed nozzle assembly; and a plurality of reflection sections provided on the reflection surface along the third direction, and inclined at different angles with respect to the first direction in which the washing water is sprayed from the fixed nozzle assembly, and the plurality of reflection sections comprise:

a first reflection section;

a second reflection section provided above the first reflection section in the third direction, and configured to guide the washing water sprayed from the fixed nozzle assembly to the third direction, wherein the second reflection section is bent from the first reflection section toward the fixed nozzle assembly; and a third reflection section provided below the first reflection section in the third direction, wherein the third reflection section is bent from the first reflection section away from the fixed nozzle assembly.

17. The dishwasher of claim 16, wherein an angle θ1, which the first reflection section forms with respect to the first direction in which the washing water is sprayed from the fixed nozzle assembly, is larger than an angle θ2, which the second reflection section forms with respect to the first direction in which the washing water is sprayed from the fixed nozzle assembly, and an angle θ3, which the third reflection section forms with respect to the first direction in which the washing water is sprayed from the fixed nozzle assembly.

18. The dishwasher of claim 16, wherein an angle θ2, which the second reflection section forms with respect to the first direction in which the washing water is sprayed from the fixed nozzle assembly, is smaller than an angle θ1, which the first reflection section forms with respect to the first direction in which the washing water is sprayed from the fixed nozzle assembly, and an angle θ3, which the third reflection section forms with respect to the first direction in which the washing water is sprayed from the fixed nozzle assembly.

19. A dishwasher comprising:

a main body;

a washing tub provided inside the main body;

a fixed nozzle assembly fixed to one side of the washing tub, and configured to spray washing water in a first direction, the fixed nozzle assembly including a fixed nozzle in which a spray hole is formed; and a vane movably installed inside the washing tub to be moved along the first direction, extending in a second direction, and configured to reflect the washing water sprayed from the spray hole of the fixed nozzle from the first direction to a third direction, wherein the fixed nozzle comprises:

a plurality of first spray flow paths positioned on an upstream side in the first direction in which the washing water is sprayed from the fixed nozzle;

a single second spray flow path positioned on a downstream side in the first direction in which the washing water is sprayed from the fixed nozzle; and a washing water accommodating portion connecting the plurality of first spray flow paths and the single second spray flow path, and having a width greater than a width of each of the plurality of first spray flow paths and a width of the single second spray flow path.

20. The dishwasher of claim 19, wherein the single second spray flow path comprises:

a straight section having the spray hole provided at a downstream end of the straight section; and a curved section connecting an upstream end of the straight section to the washing water accommodating portion.

* * * * *